US008064781B2

(12) United States Patent
Takahashi

(10) Patent No.: US 8,064,781 B2
(45) Date of Patent: Nov. 22, 2011

(54) IMAGE FORMING APPARATUS WITH RETAINING UNIT AND DETERMINING UNIT

(75) Inventor: Motoharu Takahashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 676 days.

(21) Appl. No.: 12/213,416

(22) Filed: Jun. 19, 2008

(65) Prior Publication Data

US 2009/0003869 A1 Jan. 1, 2009

(30) Foreign Application Priority Data

Jun. 25, 2007 (JP) ..... 2007-166218

(51) Int. Cl.
*G03G 15/00* (2006.01)

(52) U.S. Cl. ..... 399/9

(58) Field of Classification Search ..... 399/82, 399/83, 124, 125, 301, 9, 12, 13
See application file for complete search history.

(56) References Cited

U.S. PATENT DOCUMENTS

2005/0286912 A1* 12/2005 Matsuzaki ..... 399/9

FOREIGN PATENT DOCUMENTS

JP 2001-066843 3/2001

* cited by examiner

*Primary Examiner* — David Gray
*Assistant Examiner* — Gregory H Curran
(74) *Attorney, Agent, or Firm* — Kubotera & Associates, LLC

(57) ABSTRACT

An image forming apparatus includes an opening-closing lid for opening and closing an opening portion formed in an apparatus main body; a detection unit for detecting an open state of the opening-closing lid; an execution unit for executing a specific operation; a main power source for supplying power to the execution unit; a retaining unit for retaining an open history indicating the open state of the opening-closing lid when the detection unit detects the open state of the opening-closing lid during a period of time when the main power source does not supply power to the execution unit; and a determining unit for determining whether the execution unit executes the specific operation according to the open history retained in the retaining unit when the main power source starts supplying power to the execution unit.

11 Claims, 15 Drawing Sheets

IMAGE FORMING APPARATUS WITH RETAINING UNIT AND DETERMINING UNIT

BACKGROUND OF THE INVENTION

The present invention relates to an image forming apparatus for forming a color image with an electro-photography method.

In an image forming apparatus such as a color printer, a color copier, a color multi-function product, and the likes for forming a color image with an electro-photography method, a plurality of image forming units is detachably disposed along a transport belt for transporting a recording medium. Each of the image forming units includes a photosensitive drum. A toner image in each color is formed on the photosensitive drum, so that the toner image is sequentially overlapped and transferred to the recording medium, thereby forming a color image (refer to Patent Reference).

Patent Reference: Japan Patent Publication No. 2001-66843

In the conventional image forming apparatus, when the image forming unit has a dimensional variance, or is disposed at a shifted position, a toner image in each color is formed at a shifted position or color shift occurs, thereby deteriorating image quality.

In order to securely prevent the color shift, in the conventional image forming apparatus, when it is detected that the image forming unit is disposed at a shifted position, a color shift detection process is performed as follows.

After an image pattern formed of a toner image in each color is formed on the transport belt, the conventional image forming apparatus detects a positional relationship of the image pattern of the toner image in each color, so that the conventional image forming apparatus determines a color shift amount in advance upon forming a color image. The color shift amount is stored as a color shift correction amount.

Accordingly, when the conventional image forming apparatus forms a color image, the toner image in each color is transferred to a position shifted by the color shift correction amount thus stored, thereby preventing the color shift in a color image.

When the image forming unit is attached or detached during power off, the color shift correction amount tends to change. Accordingly, in the conventional image forming apparatus, the color shift detection process is performed when power is turned on, in addition to when it is detected that the image forming unit is attached or detached.

In the conventional image forming apparatus, even when the image forming unit is not attached or detached during power off, the color shift detection process is performed, thereby wasting toner. Further, it takes a long period of time to start up the conventional image forming apparatus.

In view of the problem described above, an object of the invention is to provide an image forming device, in which it is possible to solve the problems of the conventional developing device. In the image forming apparatus of the present invention, it is possible to securely correct the color shift. Further, it is possible to eliminate an unnecessary color shift detection process.

Further objects of the invention will be apparent from the following description of the invention.

SUMMARY OF THE INVENTION

In order to attain the objects described above, according to the present invention, an image forming apparatus includes an opening-closing lid for opening and closing an opening portion formed in an apparatus main body; a detection unit for detecting an open state of the opening-closing lid; an execution unit for executing a specific operation; a main power source for supplying power to the execution unit; a retaining unit for retaining an open history indicating the open state of the opening-closing lid when the detection unit detects the open state of the opening-closing lid during a period of time when the main power source does not supply power to the execution unit; and a determining unit for determining whether the execution unit executes the specific operation according to the open history retained in the retaining unit when the main power source starts supplying power to the execution unit.

In the image forming apparatus of the present invention, the retaining unit retains the open history when the detection unit detects the open state of the opening-closing lid during a period of time when the main power source does not supply power to the execution unit. Then, the determining unit determines the open history retained in the retaining unit when the main power source starts supplying power to the execution unit. Accordingly, when the open history is not retained in the retaining unit, it is possible to eliminate a process associated with opening and closing the opening-closing lid, thereby reducing cost and a start-up time.

BRIEF DESCRIPTION OF THE DRAWINGS

FIGS. 6(A) and 6(B) are schematic views showing the pattern for detecting the color shift in the main scanning direction according to the first embodiment of the present invention, wherein FIG. 6(A) is a view showing the pattern without the color shift, and FIG. 6(B) is a view showing the pattern with the color shift;

DETAILED DESCRIPTION OF THE PREFERRED EMBODIMENTS

Hereunder, embodiments of the present invention will be described in more detail with reference to the accompanying drawings. The present invention is applied to a color printer.

First Embodiment

Figure 2:
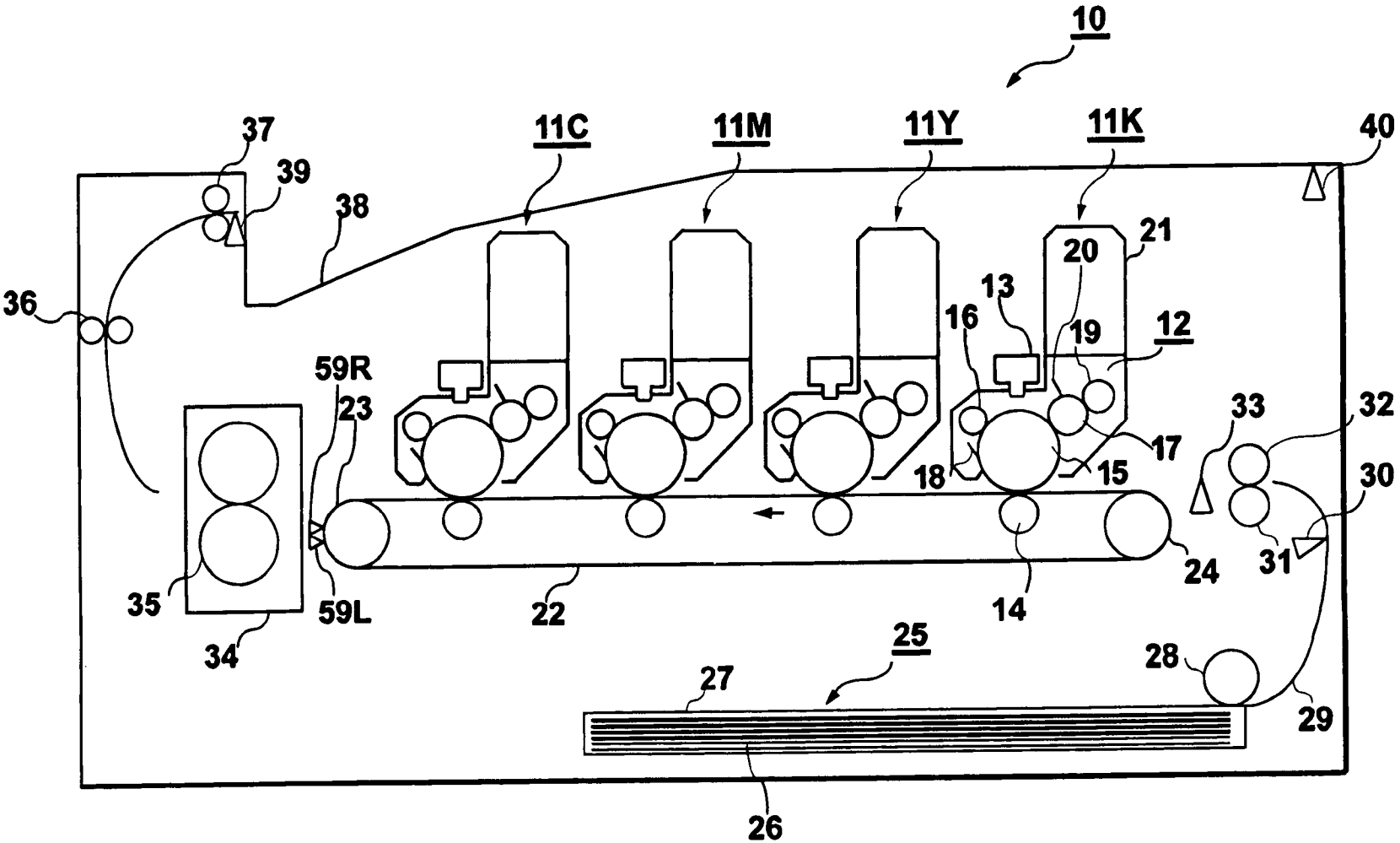
FIG. 2 is a schematic side sectional view showing the color printer according to the first embodiment of the present invention.

A first embodiment of the present invention will be explained. FIG. 2 is a schematic side sectional view showing a color printer 10 according to the first embodiment of the present invention.

In the embodiment, the color printer 10 as an image forming apparatus forms a color image through overlapping toner images in four colors of cyan, magenta, yellow, and black. In the color printer 10, four separate printing units 11K, 11Y, 11M, and 11C are disposed along a transportation path of a recording medium in a transportation direction.

In the embodiment, the printing units 11K, 11Y, 11M, and 11C are LED (Light Emitting Diode) printing units of an electro-photography type corresponding to black, yellow, magenta, and cyan, respectively. The printing units 11K, 11Y, 11M, and 11C have an identical configuration. In the following description, when it is necessary to differentiate, components of the printing units 11K, 11Y, 11M, and 11C are designated with reference numerals with K, Y, M, and C. Otherwise, the components are designated with only reference numerals. The reference numerals are shown in the printing unit 11K in FIG. 2.

In the embodiment, each of the printing units 11K, 11Y, 11M, and 11C includes an image forming unit 12 for forming a toner image; an LED head 13 as an exposure device; and a transfer roller 14 as a transfer device for transferring the toner image to a recording medium.

In the embodiment, the image forming unit 12 is disposed to be detachable, and includes a photosensitive drum 15 as a static latent image supporting member having a surface on which the toner image is formed. The photosensitive drum 15 is disposed under the image forming unit 12 to expose, and the transfer roller 14 is disposed to face the photosensitive drum 15 with the transportation path in between.

In the embodiment, the LED head 13 includes an LED array; a circuit board with a drive IC (Integrated Circuit) for driving the LED array and a register group for storing data mounted thereon; and a SELFOC lens array for collecting light of the LED array. The LED array of the LED head 13 emits light according to an image data signal input through an LED head interface portion 43 (shown in FIG. 1, described later), thereby exposing a surface of the photosensitive drum 15 to form a static latent image.

In the image forming unit 12, there are disposed around the photosensitive drum 15 a charging roller 16 as a charging device for uniformly charging the surface of the photosensitive drum 15; a developing roller 17; and a cleaning blade 18 as a cleaning device each abutting against the surface of the photosensitive drum 15.

Further, in the image forming unit 12, there are disposed around the developing roller 17 a sponge roller 19 as a toner supply member and a developing blade 20 as a toner layer thickness regulating member each abutting against a surface of the developing roller 17.

In the embodiment, a toner tank 21 as a toner container is detachably disposed above the image forming unit 12, so that toner is supplied from the toner tank 21 to inside the image forming unit 12.

When toner is supplied from the toner tank 21, toner reaches the image forming unit 12 through the sponge roller 19. Then, while the developing roller 17 rotates, the developing blade 20 forms a thin toner layer on a circumference of the developing roller 17. At this moment, toner in the thin toner layer is charged through friction between the developing roller 17 and the developing blade 20. When the thin toner layer reaches an abutting surface relative to the photosensitive drum 15, toner thus charged adheres to the static latent image formed on the surface of the photosensitive drum 15 through static electricity, thereby forming the toner image on the surface of the photosensitive drum 15.

In the embodiment, a transport belt 22 is disposed between the image forming unit 12 and the transfer roller 14. The transport belt 22 is formed of a semi-conductive plastic film having a high resistivity and a high reflectivity. The transport belt 22 is formed in an endless form without a seam, and is placed between a belt drive roller 23 and a follower roller 24 with tension. The belt drive roller 23 drives the transport belt 22 to rotate for transporting the recording medium.

In the embodiment, a sheet supply mechanism 25 is disposed under the transport belt 22. The sheet supply mechanism 25 includes a recording medium storage cassette 27 for storing a plurality of recording media 26; a hopping roller 28; a guide 29; a sheet supply sensor 30; a register roller 31; and a pinch roller 32.

The hopping roller 28 rotates to sequentially transport each of the recording media 26, and the guide 29 guides the recording medium 26. When the sheet supply sensor 30 detects the recording medium 26, and the recording medium 26 reaches between the register roller 31 and the pinch roller 32, the hopping roller 28 stops rotating. Then, the register roller 31 and the pinch roller 32 transport the recording medium 26 into the transport path.

After the recording medium 26 is transported from the sheet supply mechanism 25 to the transport path, when the recording medium 26 passes through a reading position sensor 33, the LED head 13 emits light synchronizing to a passing timing of the recording medium 26. Accordingly, in the image forming units 12K, 12Y, 12M, and 12C, the toner images in black, yellow, magenta, and cyan are formed on the surfaces of the photosensitive drums 15K, 15Y, 15M, and 15C. At this time, the transport belt 22 starts rotating, so that the recording medium 26 is transported first between the photosensitive drum 15K and the transfer roller 14K.

When the recording medium 26 is transported between the photosensitive drum 15K and the transfer roller 14K, a transfer output is applied to the transfer roller 14K. Accordingly, the toner image in black formed on the surface of the photosensitive drum 15K is transferred to a surface of the recording medium 26. At this time, the cleaning blade 18K scrapes off toner remaining on the surface of the photosensitive drum 15K.

In the following step, the recording medium 26 is sequentially transported between each of the photosensitive drums 15Y, 15M, and 15C and each of the transfer rollers 14Y, 14M, and 14C. Accordingly, the toner images in yellow, magenta, and cyan are sequentially transferred to the surface of the recording medium 26. After the toner images in the four colors are transferred to the recording medium 26, the transport belt 22 transports the recording medium 26 to a fixing device 34.

In the embodiment, the fixing device 34 includes a heat roller 35. When the recording medium 26 is transported to the fixing device 34, the heat roller 35 applies heat and pressure, so that the toner images in the four colors are fixed to the surface of the recording medium 26. Afterward, discharge rollers 36 and 37 discharge the recording medium 26 on to a cover 38 covering an upper portion of the color printer 10 through a discharge outlet. A discharge sensor 39 is disposed at the discharge outlet for monitoring discharge of the recording medium 26.

Figure 3:
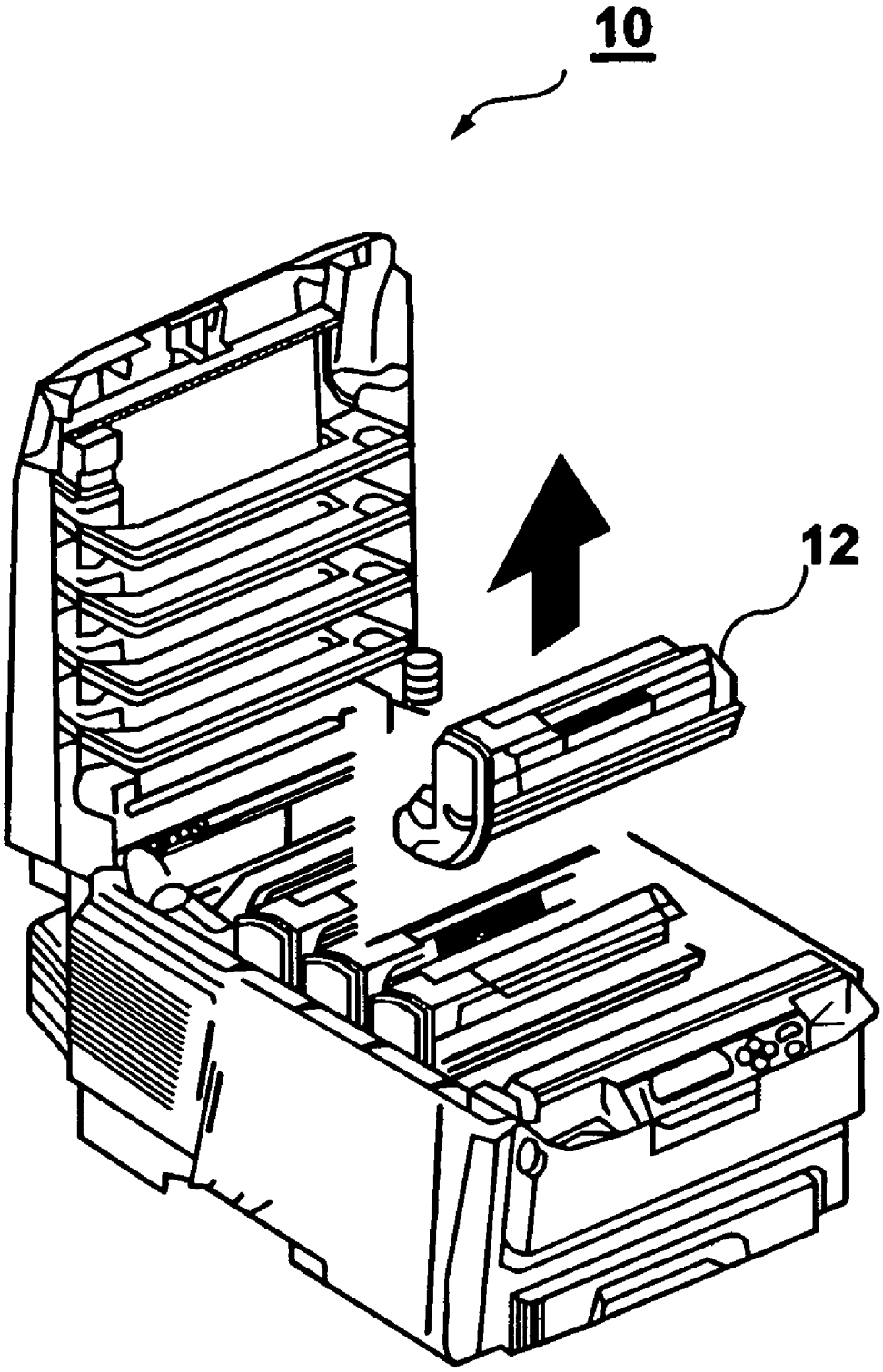
FIG. 3 is a schematic perspective view showing the color printer according to the first embodiment of the present invention.

FIG. 3 is a schematic perspective view showing the color printer 10 according to the first embodiment of the present invention. As shown in FIG. 3, each of the image forming units 12K, 12Y, 12M, and 12C is detachable upon opening the cover 38.

As shown in FIG. 2, an opening-closing detection switch 40 is disposed at the cover 38 for detecting an open state of the cover 38. Further, color shift sensors 59L and 59R are disposed between the transport belt 22 and the fixing device 34 for detecting a positional shift of the toner image in each color.

In the embodiment, each of the color shift sensors 59L and 59R is formed of a light emitting element and a light receiving element. Further, the color shift sensors 59L and 59R are disposed at both end portions of the transport belt 22 in a width direction thereof.

In the embodiment, the color shift sensors 59L and 59R emit light toward a color shift detection pattern (described later) transferred on the transport belt 22, and receive light from the color shift detection pattern for outputting signals according to an amount of light thus received. Accordingly, the color shift sensors 59L and 59R detect a positional shift in the color shift detection pattern as a color shift amount when the image forming units 12 are disposed at positions shifted from correct positions due to a dimensional variance of a component thereof or a installation problem. A detail of the detection of the color shift amount with the color shift sensors 59L and 59R will be described later.

Figure 1:
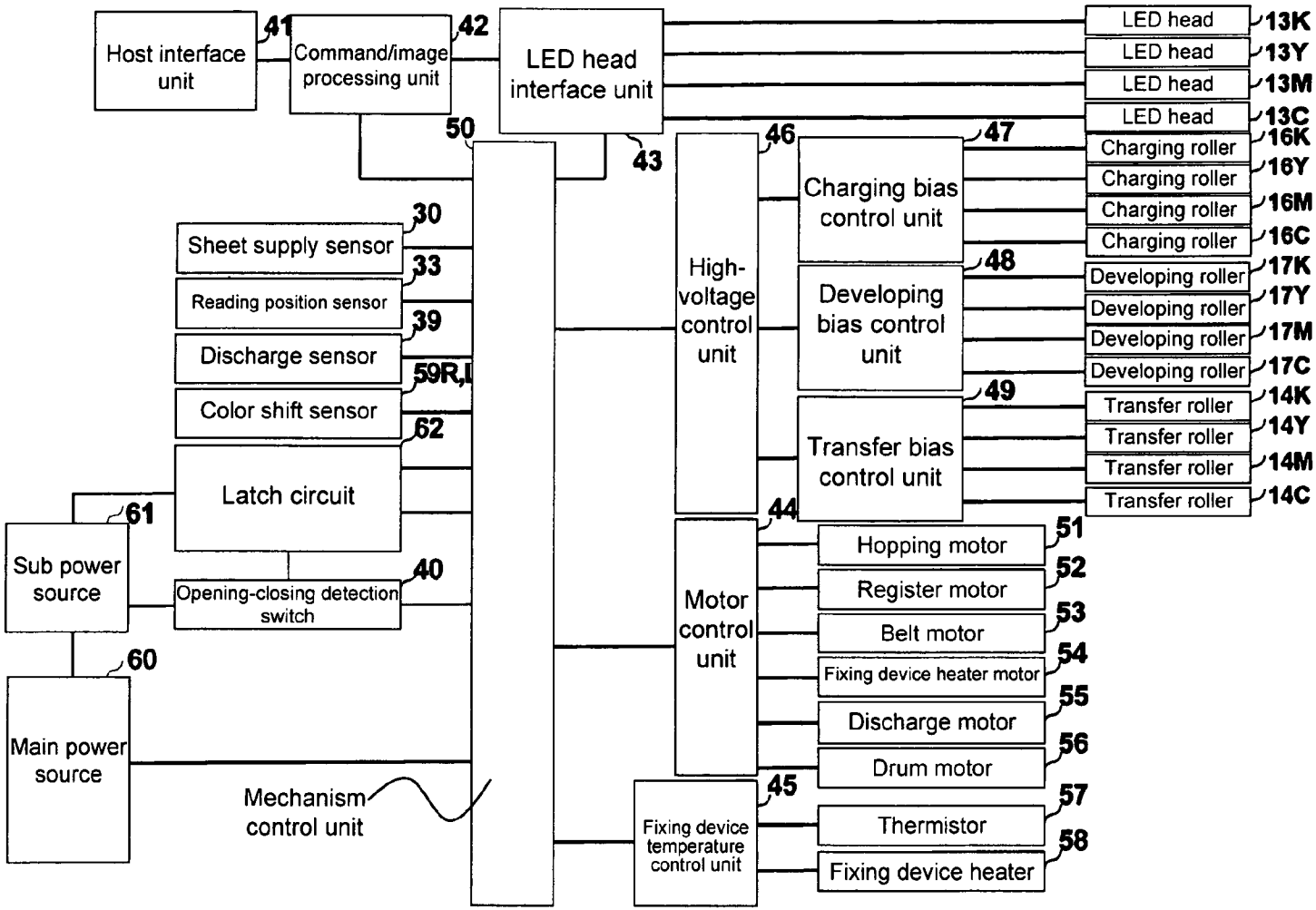
FIG. 1 is a block diagram showing a configuration of a color printer according to a first embodiment of the present invention.

A control system of the color printer 10 will be explained next. FIG. 1 is a block diagram showing a configuration of the color printer 10 according to a first embodiment of the present invention.

As shown in FIG. 1, the color printer 10 includes a host interface unit 41; a command/image processing unit 42; an LED head interface unit 43; a motor control unit 44; a fixing device temperature control unit 45; a high-voltage control unit 46; a charging bias control unit 47; a developing bias control unit 48; a transfer bias control unit 49; and a mechanism control unit 50.

In the embodiment, the host interface unit 41 functions as an interface in a physical hierarchy with respect to a host device (not shown) such as a personal computer (PC) and the likes, and is formed of a connector, a chip for communication, and the likes. The host interface unit 41 receives a command for directing execution of a printing process, an image data signal to be printed, and the likes from the host device, and sends the command and the image data signal to the command/image processing unit 42.

In the embodiment, the command/image processing unit 42 is a processing unit for executing an interpretation process of the command received from the host device through the host interface unit 41, a deployment process to a bit map of image data described with PDL (Page Description Language) and the likes, and other processes. The command/image processing unit 42 is formed of a microprocessor, an RAM (Random Access Memory), and the likes.

After the interpretation process, the command/image processing unit 42 outputs the command to the mechanism control unit 50. After the deployment process, the command/image processing unit 42 outputs the image data signal to the LED head interface portion 43. Further, the command/image processing unit 42 stores detection pattern data (described later) for a color shift detection process.

In the embodiment, the LED head interface portion 43 has a function of processing the image data signal input from the command/image processing unit 42 according to an interface of the LED heads 13, and is formed of a semi-custom LSI (Large Scale Integrated circuit), an RAM, and the likes.

In the embodiment, the motor control unit 44 controls various motors such as a hopping motor 51, a register motor 52, a belt motor 53, a fixing device heater motor 54, a discharge motor 55, a drum motor 56 and the likes.

In the embodiment, the hopping motor 51 is a drive unit for driving the hopping roller 28 to rotate. The resister motor 52 drives the register roller 31 and the pinch roller 32 to rotate. The belt motor 53 drives the belt drive roller 23 to rotate the transport belt 22. The fixing device heater motor 54 drives the heat roller 35 disposed in the fixing device 34. The discharge motor 55 drives the discharge rollers 37 and 37 to rotate. The drum motor 56 drives the photosensitive drums 15 disposed in the image forming units 12.

In the embodiment the fixing device temperature control unit 45 controls a temperature of the fixing device 34 according to a temperature of the heat roller 35 detected with a thermistor 57. The thermistor 57 is disposed to contact with an outer circumference of the heat roller 35 for detecting a temperature of the heat roller 35 and sending a result to the fixing device temperature control unit 45.

In the embodiment, a fixing device heater 58 is formed of a halogen lamp disposed inside the heat roller 35. The fixing device temperature control unit 45 controls the fixing device heater 58 to receive power from a main power source 60 (described later), thereby heating the heat roller 35.

In the embodiment, the high-voltage control unit 46 is formed of a microprocessor or a custom LSI for supplying a charging bias, a developing bias, and a transfer bias to the printing units 11K, 11Y, 11M, and 11C to control the charging bias control unit 47, the developing bias control unit 48, and the transfer bias control unit 49, respectively.

In the embodiment, the charging bias control unit 47 controls supply and termination of the charge bias to the charging rollers 16 disposed in the printing units 11K, 11Y, 11M, and 11C. Further, the developing bias control unit 48 controls supply and termination of the developing bias to the developing rollers 17 disposed in the printing units 11K, 11Y, 11M, and 11C. Further, the transfer bias control unit 49 controls supply and termination of the transfer bias to the transfer rollers 14 disposed in the printing units 11K, 11Y, 11M, and 11C.

In the embodiment, the mechanism control unit 50 includes a CPU (Central Processing Unit) formed of a microprocessor, a program ROM (Read Only Memory), and various interfaces. The mechanism control unit 50 monitors inputs from various sensors such as the sheet supply sensor 30, the reading position sensor 33, the discharge sensor 39, and the likes according to the command received from the command/image processing unit 42, thereby controlling the LED head interface portion 43, the motor control unit 44, the fixing device temperature control unit 45, and the high-voltage control unit 46, respectively.

As shown in FIG. 2, the color printer 10 further includes the main power source 60, a sub power source 61, and a latch circuit 62.

In the embodiment, the main power source 60 generates a voltage of 24 V for driving the mechanisms, a voltage of 5 V for driving the sensors, and a voltage of 3.3 V for driving the CPU, thereby supplying power to each component through the mechanism control unit 50. A power switch 63 (described later) is connected to the main power source 60. When the power switch 63 is closed to become a power on state, the main power source 60 starts supplying power to the mechanism control unit 50.

In the embodiment, the sub power source 61 is formed of a separate battery or a chargeable battery connected to the main power source 60 for supplying a voltage of 3.3 V to the opening-closing detection switch 40 and the main power source 60 all the time.

In the embodiment, the latch circuit 62 functions as a retaining portion for retaining an open history indicating that the cover 38 is or has been opened. The sub power source 61 supplies power to the latch circuit 62 all the time, so that the latch circuit 62 sends a signal to the mechanism control unit 50 depending on whether the retaining portion retains the open history.

In the embodiment, in addition to the function of controlling each component described above, the mechanism control unit 50 has a determination function, an execution function, and a release function (described later).

Figure 4:
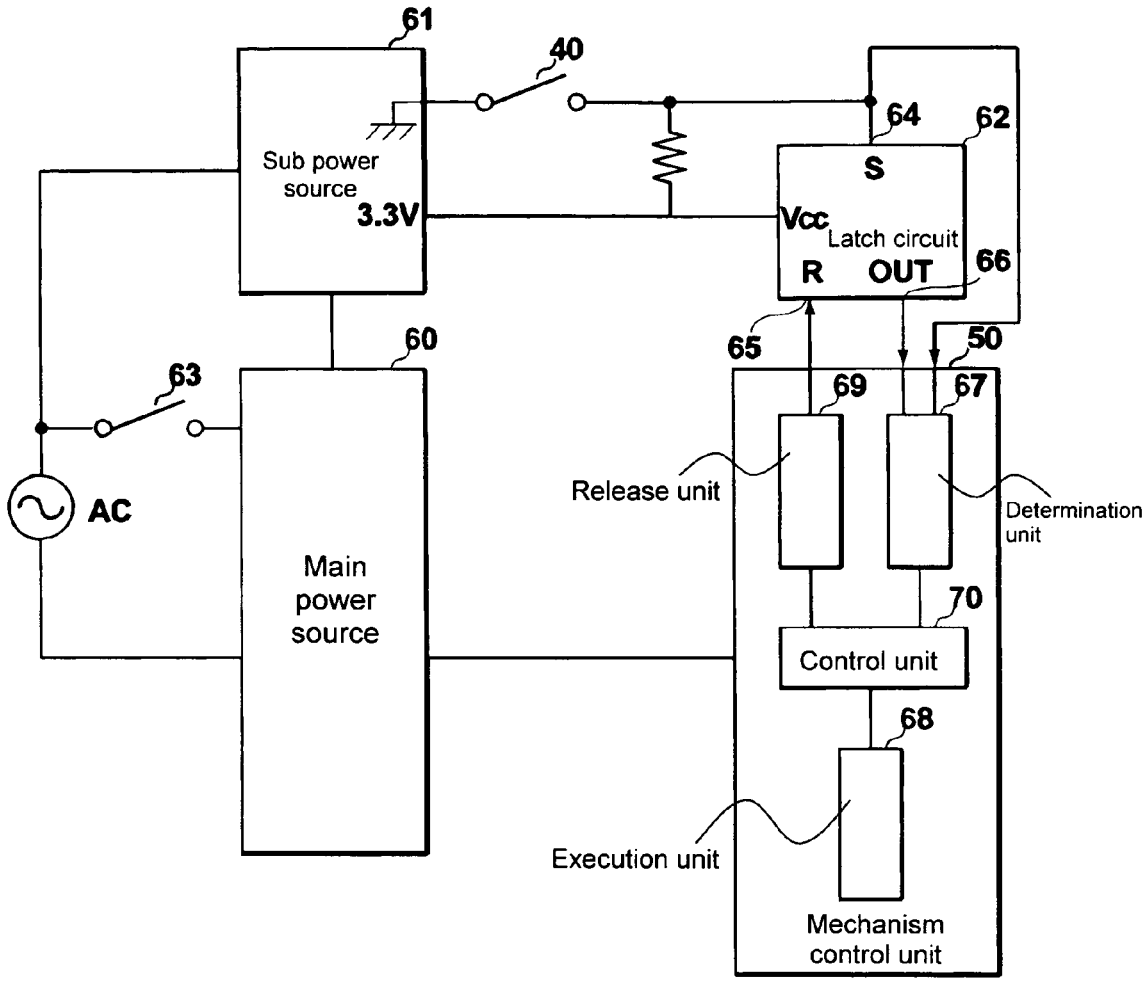
FIG. 4 is a block diagram showing a circuit diagram including a latch circuit according to the first embodiment of the present invention.

A functional configuration of the latch circuit 62 and the mechanism control unit 50 will be explained in more detail next with reference to FIG. 4. FIG. 4 is a block diagram showing a circuit diagram including the latch circuit 62 according to the first embodiment of the present invention.

As shown in FIG. 4, the latch circuit 62 includes a set input terminal 64, a reset input terminal 65, and an output terminal 66. As described above, the sub power source 61 supplies a power source voltage Vcc to the latch circuit 62 all the time, so that the latch circuit 62 sends a signal to the mechanism control unit 50 through the output terminal 66. According to an input through the set input terminal 64 and the reset input terminal 65, the latch circuit 62 becomes one of a set state and a reset state.

As shown in FIG. 4, the set input terminal 64 of the latch circuit 62 is connected to the sub power source 61 through the opening-closing detection switch 40. When the cover 38 is opened or closed, the opening-closing detection switch 40 operates to notify the latch circuit 62 and the mechanism control unit 50 that an open state of the cover 38 is detected. For example, when the cover 38 becomes the open state and the opening-closing detection switch 40 is opened, the sub power source 61 outputs a voltage of 3.3 V to the mechanism control unit 50 and the set input terminal 64 of the latch circuit 62.

In the embodiment, it is supposed that the input to the set input terminal 64 upon opening the opening-closing detection switch 40 is referred to as a high level input. According to the high level input from the set input terminal 64, the latch circuit 62 retains the open history indicating that the open state of the cover 38 is detected, thereby becoming the set state.

When the cover 38 becomes the close state and the opening-closing detection switch 40 is closed, the input to the mechanism control unit 50 and the set input terminal 64 of the latch circuit 62 becomes a low level input. In the set state, when the input from the set input terminal 64 becomes the low level, the latch circuit 62 also retains the open history and maintains the set state.

In the embodiment, as shown in FIG. 4, the reset input terminal 65 of the latch circuit 62 is connected to the mechanism control unit 50. When the latch circuit 62 retains the open history and maintains the set state, the output terminal 66 of the latch circuit 62 outputs a signal indicating that the latch circuit 62 retains the open history, i.e., a high level signal. When the latch circuit 62 does not retain the open history, that is the latch circuit 62 becomes the reset state, the output terminal 66 outputs a low level signal.

As shown in FIG. 4, the mechanism control unit 50 includes a determination unit 67; an execution unit 68; a release unit 69; and a control unit 70 for controlling the determination unit 67, the execution unit 68, and the release unit 69.

In the embodiment, the determination unit 67 determines whether the color shift detection process (described later) is necessary according to a signal input from the latch circuit 62. When the signal input from the latch circuit 62 is the high level signal, the determination unit 67 determines that the latch circuit 62 is in the set state and retains the open history, that is, the cover 38 is opened and closed while the main power source 60 is powered off. In this case, the determination unit 67 determines that the color shift detection process is necessary, and sends a determination result to the control unit 70.

When the low level signal is input from the latch circuit 62, the determination unit 67 determines that the latch circuit 62 is in the reset state and does not retain the open history, that is, the cover 38 is not opened and closed while the main power source 60 is turned off. In this case, the determination unit 67 determines that the color shift detection process is not necessary, and sends a determination result to the control unit 70.

Further, when the opening-closing detection switch 40 is opened, and the output from the sub power source 61 is the high level output, the determination unit 67 determines that the cover is opened, and sends a determination result to the control unit 70.

When the execution unit 68 receives a color shift detection direction from the control unit 70, the execution unit 68 performs the color shift detection process (described later). When the release unit 69 receives a release direction from the control unit 70, the release unit 69 sends a release signal to be input to the reset input terminal 65 of the latch circuit 62. When the determination unit 67 notifies the control unit 70 that the color shift detection process is necessary, the control unit 70 sends the color shift detection direction to the execution unit 68 for executing the color shift detection process.

After the color shift detection process is executed, the control unit 70 sends the release direction to the release unit 69 for releasing the open history retained in the latch circuit 62. When the release signal is input to the reset input terminal 65 of the latch circuit 62, the latch circuit 62 becomes the reset state, that is, the latch circuit 62 releases the open history retained in the latch circuit 62, and the output from the output terminal 66 becomes the low level signal.

An operation of the color printer 10 will be explained next. First, the color shift detection process of the color printer 10 will be explained.

In the color printer 10, when the image forming units 12K, 12Y, 12M, and 12C have a dimensional variance or installed at a shifted position, the color image formed through overlapping the toner image in each color may have a shift in positions of the toner image in each color, or the color shift. In order to prevent the color shift, the color printer 10 performs the color shift detection process as follows.

In the embodiment, in the color printer 10, the toner image in black is formed on the transport belt 22 with the printing unit 11K as a standard. Then, it is arranged to detect a shift of a position of the toner image in yellow, magenta, or cyan formed with one of the printing units 11Y, 11M, 11C from the toner image in black as a color shift amount.

In the following description, the toner image in yellow, magenta, or cyan is referred to as a color toner image. A detection process of the color shift amount of the color toner image will be explained next as the toner image in yellow as an example.

Figure 5:
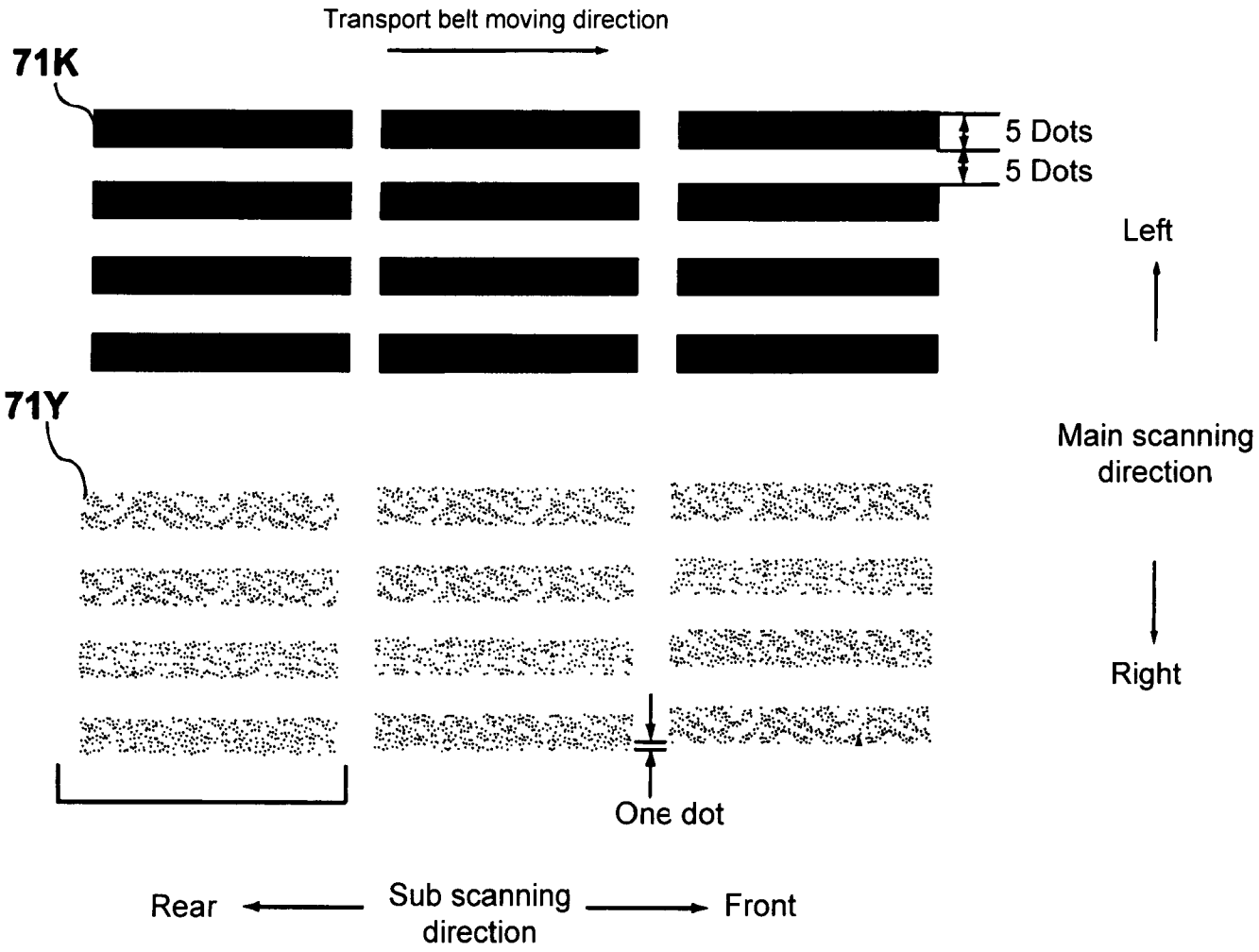
FIG. 5 is a schematic view showing a pattern for detecting color shift in a main scanning direction according to the first embodiment of the present invention.
Figure 6:
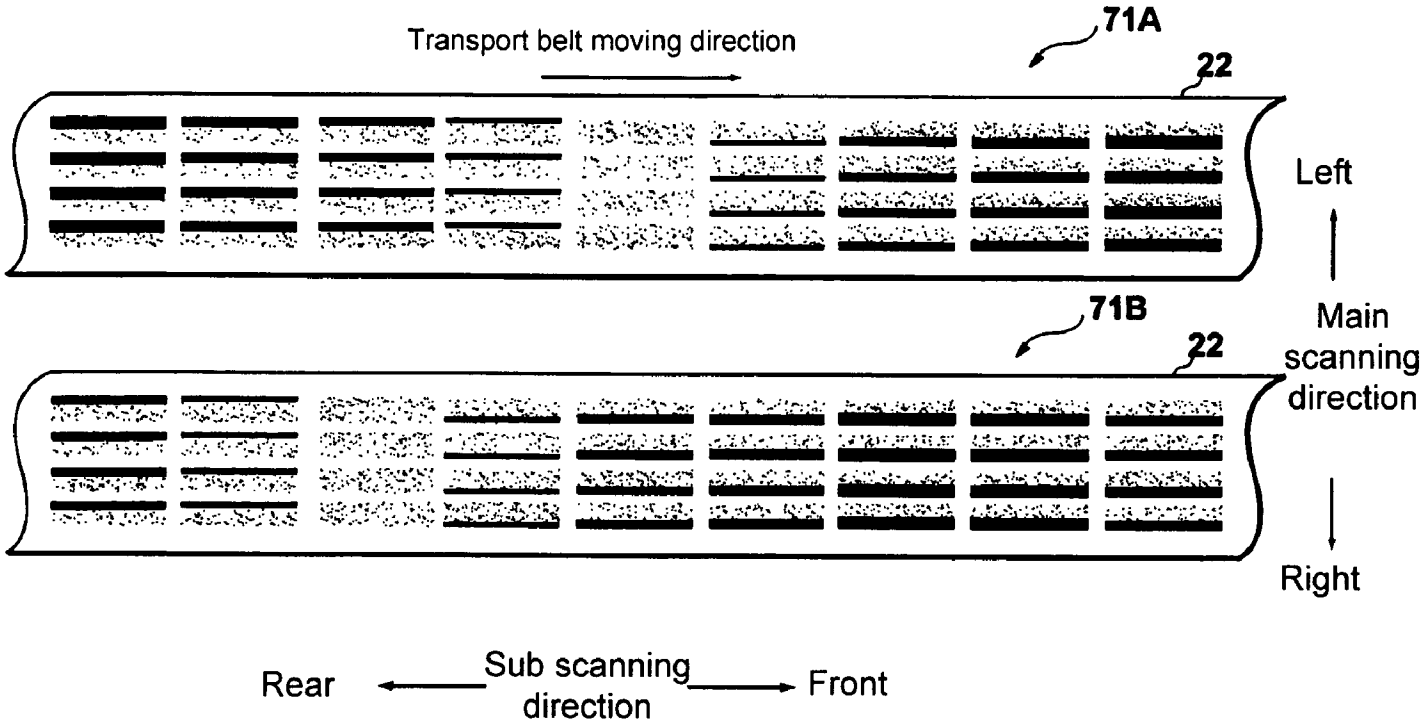

First, a detection pattern used of the shift detection process will be explained. FIG. 5 is a schematic view showing the pattern for detecting the color shift in a main scanning direction according to the first embodiment of the present invention. FIGS. 6(A) and 6(B) are schematic views showing the pattern for detecting the color shift in the main scanning direction according to the first embodiment of the present invention. More specifically, FIG. 6(A) is a view showing the pattern without the color shift, and FIG. 6(B) is a view showing the pattern with the color shift.

In the embodiment, the pattern for detecting the color shift in the main scanning direction is directly transferred to the transport belt 22 for detecting the color shift amount in the main scanning direction.

As shown in FIG. 5, the pattern for detecting the color shift in the main scanning direction is formed at an upper portion using black toner (referred to as a black main pattern 71K). Further, the pattern for detecting the color shift in the main scanning direction is formed at a lower portion using yellow toner (referred to as a yellow main pattern 71Y) away from the black main pattern 71K.

In the embodiment, the pattern for detecting the color shift in the main scanning direction is formed through overlapping the yellow main pattern 71Y on the transport belt 22 with the black main pattern 71K transferred thereon.

In FIG. 5, the main scanning direction corresponds to a vertical direction, and a sub scanning direction corresponds to a lateral direction. Further, the transport belt 22 moves in an arrow direction shown at an upper portion of FIG. 5. As shown in FIG. 5, the transport belt 22 moves in the sub scanning direction perpendicular to the main scanning direction, that is, the main scanning direction becomes a right-to-left direction with respect to the moving direction of the transport belt 22.

As shown in FIGS. 6(A) and 6(B), in the pattern for detecting the color shift in the main scanning direction, the black main pattern 71K is formed of nine identical blocks. Each of the blocks has four lines arranged at an interval of 5 dots in the main scanning direction. The nine blocks are arranged with a constant interval in the sub scanning direction, thereby constituting the black main pattern 71K.

In the embodiment, each of the lines in each of the blocks has a width of 5 dots, and is situated at a same position with respect to the sub scanning direction. In the following description, the blocks are referred to as a first block to a ninth block from a front side in the sub scanning direction.

In the embodiment, the yellow main pattern 71Y is formed of nine identical blocks as well (only three blocks are shown in FIG. 5). In the following description, similar to the black main pattern 71K, the blocks of the yellow main pattern 71Y are referred to as a first block to a ninth block from the front side in the sub scanning direction.

In the embodiment, each block of the yellow main pattern 71Y has a configuration similar to that of the black main pattern 71K, except that the blocks of the yellow main pattern 71Y are arranged in the main scanning direction differently from those of the black main pattern 71K.

That is, an n-th block (n=1, 2, . . . , 8) from the front side in the scanning direction is formed at a position shifted toward the right side in the main scanning direction by (n−5) dots with respect to the fifth block from the front side in the sub scanning direction. More specifically, the first block in the sub scanning direction is printed at a position shifted toward the left side in the main scanning direction by 4 dots with respect to the fifth block. Further, the ninth block in the sub scanning direction is printed at a position shifted toward the right side in the main scanning direction by 4 dots with respect to the fifth block.

In the embodiment, the black main pattern 71K is overlapped with the yellow main pattern 71Y to form the pattern for detecting the color shift in the main scanning direction 71A. When there is no color shift, as shown in FIG. 6(A), the black main pattern 71K is overlapped with the yellow main pattern 71Y, so that the fifth blocks thereof are overlapped without a shift.

In this case, from the fifth block toward the block on the front side in the sub scanning direction, the yellow main pattern 71Y is shifted toward the left side in the main scanning direction by one dot with respect to the black main pattern 71K. From the fifth block toward the block on the rear side in the sub scanning direction, the yellow main pattern 71Y is shifted toward the right side in the main scanning direction by one dot with respect to the black main pattern 71K.

When there is the color shift, in the pattern for detecting the color shift in the main scanning direction 71B, the black main pattern 71K is overlapped with the yellow main pattern 71Y, so that the blocks overlapped without a shift are moved from the fifth blocks.

For example, as shown in FIG. 6(B), the black main pattern 71K is overlapped with the yellow main pattern 71Y such that the seven blocks thereof are overlapped without a shift. That is, in the pattern for detecting the color shift in the main scanning direction 71B, the yellow main pattern 71Y are printed at a position shifted toward the left side in the main scanning direction by 2 dots with respect to the black main pattern 71K.

Accordingly, in the pattern for detecting the color shift in the main scanning direction 71B described above, through identifying the blocks without the shift, it is possible to detect the color shift amount, i.e., the shift in the position of the yellow toner image in the main scanning direction with respect to the black toner image, within a range of 4 dots in the right and left direction.

In the embodiment, the output from the color shift sensors 59L and 59R are used for detecting the blocks without the shift. As described above, the mechanism control unit 50 controls the color shift sensors 59L and 59R to emit light toward the transport belt 22 with the pattern for detecting the color shift in the main scanning direction printed thereon, and to receive light therefrom, thereby outputting a signal according to an amount of light thus received.

In general, black toner has a significantly lower reflectivity as opposed to color toner of yellow, magenta, or cyan. As described above, the transport belt 22 has a high reflectivity. Accordingly, in the blocks of the pattern for detecting the color shift in the main scanning direction, when the color toner image is shifted with respect to the black toner image to a smaller extent, the output from the color shift sensors 59L and 59R increases.

Accordingly, the blocks with no shift are detected as blocks having a largest output from the color shift sensors 59L and 59R. According to a position of the blocks, the color shift amount in the main scanning direction is detected.

For example, in the pattern for detecting the color shift in the main scanning direction 71A shown in FIG. 6(A), the fifth blocks are detected as the blocks without shift, thereby detecting the color shift amount in the main scanning direction of zero dot.

In the pattern for detecting the color shift in the main scanning direction 71B shown in FIG. 6(B), the seventh blocks are detected as the blocks without shift, thereby detecting the color shift amount in the main scanning direction of −2 dots. Note that, in the embodiment, the color shift amount in the main scanning direction becomes positive when shifted toward the right side, and becomes negative when shifted toward the left side.

Figure 7:
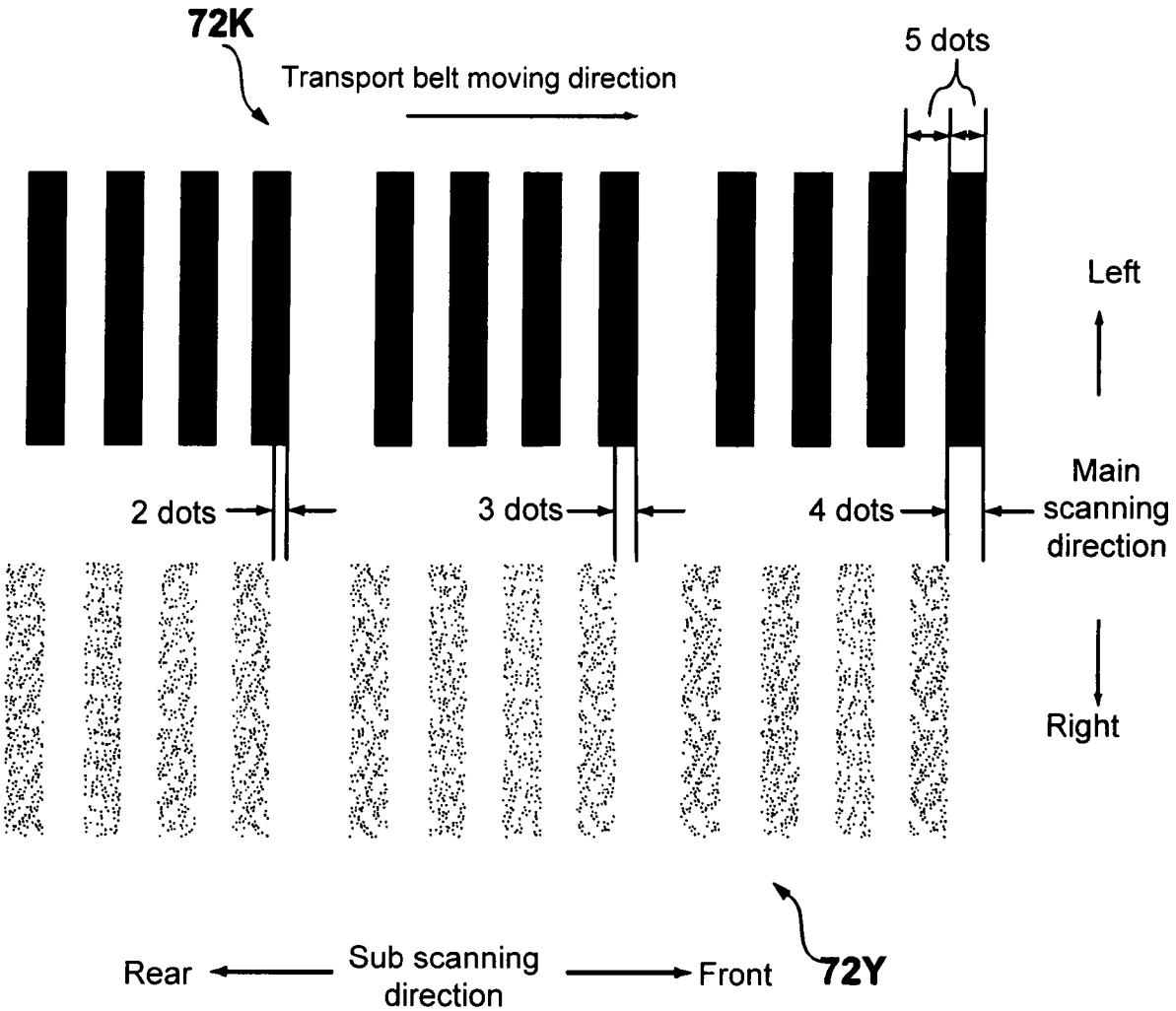
FIG. 7 is a schematic view showing a pattern for detecting color shift in a sub scanning direction according to the first embodiment of the present invention.

FIG. 7 is a schematic view showing a pattern for detecting color shift in the sub scanning direction according to the first embodiment of the present invention.

In the embodiment, the pattern for detecting color shift in the sub scanning direction is directly transferred to the transport belt 22 for detecting a color shift amount in the sub scanning direction.

As shown in FIG. 7, the pattern for detecting the color shift in the sub scanning direction is formed at an upper portion using black toner (referred to as a black sub pattern 72K). Further, the pattern for detecting the color shift in the sub scanning direction is formed at a lower portion using yellow toner (referred to as a yellow sub pattern 72Y) away from the black sub pattern 72K.

In the embodiment, the pattern for detecting the color shift in the sub scanning direction is formed through overlapping the yellow sub pattern 72Y on the transport belt 22 with the black sub pattern 72K transferred thereon.

In the pattern for detecting the color shift in the sub scanning direction, similar to the black main pattern 71K (refer to FIG. 5), the black sub pattern 72K is formed of nine identical blocks (only three blocks are shown in FIG. 7). Different from the black main pattern 71K (refer to FIG. 5), each of the blocks has four lines arranged at an interval of 5 dots in the sub scanning direction and situated at a same position with respect to the main scanning direction. Each of the lines in each of the blocks has a width of 5 dots. The nine blocks are arranged with a constant interval in the sub scanning direction. Further, the blocks are referred to as a first block to a ninth block from the front side in the sub scanning direction.

In the embodiment, similar to the black sub pattern 72K, the yellow sub pattern 72Y is formed of nine identical blocks as well. In the following description, the blocks of the yellow sub pattern 72Y are similarly referred to as a first block to a ninth block from the front side in the sub scanning direction.

In the embodiment, each block of the yellow sub pattern 72Y has a configuration similar to that of the black sub pattern 72K, except that the blocks of the yellow sub pattern 72Y are arranged in the sub scanning direction differently from those of the black sub pattern 72K.

That is, each block is printed at a position shifted toward the rear side by one dot in the sub scanning direction. Accordingly, a distance between an (n+1)-th block (n=1, 2, . . . , 8) and an (n+2)th block becomes larger by one dot than a distance between an n-th block and an (n+1)th block. More specifically, a distance between the eighth block and the ninth block is larger by 7 dots than a distance between the first block and the second block.

In the embodiment, the black sub pattern 72K is overlapped with the yellow sub pattern 72Y, thereby forming the pattern for detecting the color shift in the sub scanning direction. Using the pattern for detecting the color shift in the sub scanning direction, it is possible to detect the shift of the yellow sub pattern 72Y with respect to the black sub pattern 72 within a range of 4 dots. Further, it is possible to detect the color shift amount inclined obliquely. Note that, the color shift amount in the sub scanning direction detected with the pattern for detecting the color shift in the sub scanning direction becomes positive when shifted toward the right side, and becomes negative when shifted toward the left side.

A flow of the color shift detection process performed with the color printer 10 will be explained next. When the execution unit 68 in the mechanism control unit 50 receives the color shift detection direction from the control unit 70, the execution unit 68 controls each component to form the black toner pattern and the yellow toner pattern for the color shift detection process. Accordingly, each motor starts driving, and the transport belt 22 starts rotating. The printing units 11K and 11Y form the pattern for detecting the color shift in the main scanning direction, so that the color shift in the main scanning direction is detected.

More specifically, the black main pattern 71K is formed on the surface of the photosensitive drum 15K using black toner. The yellow main pattern 71Y is formed on the surface of the photosensitive drum 15Y using yellow toner. Then, the black main pattern 71K and the yellow main pattern 71Y are directly transferred to the transport belt 22, thereby forming the pattern for detecting the color shift in the main scanning direction as shown in FIGS. 6(A) and 6(B). Similarly, a magenta main pattern and a cyan main pattern are overlapped with the black main pattern 71K, thereby forming patterns for detecting the color shift in the main scanning direction with respect to the toner images in magenta and cyan.

In the next step, the execution unit 68 controls the color shift sensors 59L and 59R to emit light. While the transport belt 22 is rotating, when a portion of the transport belt 22 with the pattern for detecting the color shift in the main scanning direction formed thereon passes through the color shift sensors 59L and 59R, the color shift sensors 59L and 59R receive light reflecting from the pattern for detecting the color shift in the main scanning direction, thereby outputting the signal according to an amount of light thus received.

Then, the execution unit 68 receives the outputs from the color shift sensors 59L and 59R, and identifies the block having a largest sum of the outputs thus received. Accordingly, the execution unit 68 determines an amount of the color shift in the main scanning direction according to a position of the block thus identified. After the execution unit 68 determines an amount of the color shift in each of yellow, magenta, and cyan in the main scanning direction, the execution unit 68 stores the amounts in a memory (not shown) in the mechanism control unit 50.

Further, the printing units 11K and 11Y form the patterns for detecting the color shift in the sub scanning direction and the oblique direction, so that the color shift in the main scanning direction and the oblique direction is detected.

More specifically, the black sub pattern 72K is formed on the surface of the photosensitive drum 15K using black toner. The yellow sub pattern 72Y is formed on the surface of the photosensitive drum 15Y using yellow toner. Then, the black sub pattern 72K and the yellow sub pattern 72Y are directly transferred to the transport belt 22, thereby forming the pattern for detecting the color shift in the sub scanning direction. Similarly, a magenta sub pattern and a cyan sub pattern are overlapped with the black sub pattern 72K, thereby forming patterns for detecting the color shift in the sub scanning direction with respect to the toner images in magenta and cyan.

While the transport belt 22 is rotating, when a portion of the transport belt 22 with the pattern for detecting the color shift in the sub scanning direction formed thereon passes through the color shift sensors 59L and 59R, the color shift sensors 59L and 59R receive light reflecting from the pattern for detecting the color shift in the sub scanning direction, thereby outputting the signal according to an amount of light thus received.

Then, the execution unit 68 receives the outputs from the color shift sensors 59L and 59R, and identifies the block having a largest sum of the outputs thus received. Accordingly, the execution unit 68 determines an amount of the color shift in the sub scanning direction according to a position of the block thus identified. After the execution unit 68 determines an amount of the color shift in each of yellow, magenta, and cyan in the sub scanning direction, the execution unit 68 stores the amounts in a memory (not shown) in the mechanism control unit 50.

Further, the execution unit 68 determines an amount of the color shift at a left edge of the pattern for detecting the color shift in the sub scanning direction according to the output of the color shift sensor 59L, and determines an amount of the color shift at a right edge of the pattern for detecting the color shift in the sub scanning direction according to the output of the color shift sensor 59R. Then, the mechanism control unit 50 stores the amounts at the left and right edges into a memory (not shown) as a left color shift amount and a right color shift amount.

As described above, the amount of the color shift in each of yellow, magenta, and cyan is detected and stored in each of the main scanning direction, the sub scanning direction, and the oblique direction, respectively.

In the embodiment, the color printer 10 performs the color shift correction process according to the amount of the color shift thus detected and stored as follows.

In correcting the color shift in the main scanning direction, the LED head interface portion 43 sends the image data signal to the LED head 13 at an adjusted timing. For example, when the amount of the color shift in yellow in the main scanning direction is −2 dots (refer to FIG. 6(B)), the mechanism control unit 50 notifies the LED head interface portion 43 to send the image data signal in yellow at a timing delayed by an amount corresponding to 2 dots.

When the LED head interface portion 43 is notified, the LED head interface portion 43 sends the image data signal in yellow to the LED head 13Y at the timing delayed by the amount corresponding to 2 dots, so that the toner image in yellow is shifted toward the right side by 2 dots. Similarly, with respect to magenta and cyan, positions of the toner images are shifted with that of the toner image in black as the standard, thereby correcting the color shift in the main scanning direction.

In the embodiment, the correction of the color shift in the sub scanning direction is performed when the LED head interface portion 43 processes the image data signal. For example, when the amount of the color shift in yellow in the sub scanning direction is +3 dots, the mechanism control unit 50 notifies the LED head interface portion 43 to output the image data signal in yellow shifted forward by 3 dots.

When the LED head interface portion 43 is notified, the LED head interface portion 43 changes an address of the image data signal in yellow forward by 3 dots upon retrieving the image data signal from the memory for processing, thereby correcting the color shift in the sub scanning direction. The color shift in the sub scanning direction is similarly corrected with respect to magenta and cyan.

In correcting the color shift in the oblique direction, the corrections of the color shift in the main scanning direction and the sub scanning direction are combined. For example, when the left shift amount in yellow is zero dot and the right color shift amount in yellow is −2 dots, that is, the toner image in yellow is inclined forward toward right side by 2 dots with respect to the toner image in black, the mechanism, control unit 50 notifies the LED head interface portion 43 to output the image data signal in yellow to the LED head 13Y, so that a line shifted toward a backside by one dot is output as a first one third from a left end in the main scanning direction, a second one third from the left end is output as is, and a line shifted toward a front side by one dot is output as a last one third from the left end.

According to the notification, the LED head interface portion 43 shifts an address of the memory storing the image data signal, thereby sending to the image data signal to the LED head 13Y according to the notification. The color shift is similarly corrected with respect to magenta and cyan.

As described above, in the embodiment, the color shift is corrected with respect to each of the LED heads 13Y, 13M, and 13C, thereby obtaining the color image without the color shift.

Figure 8:
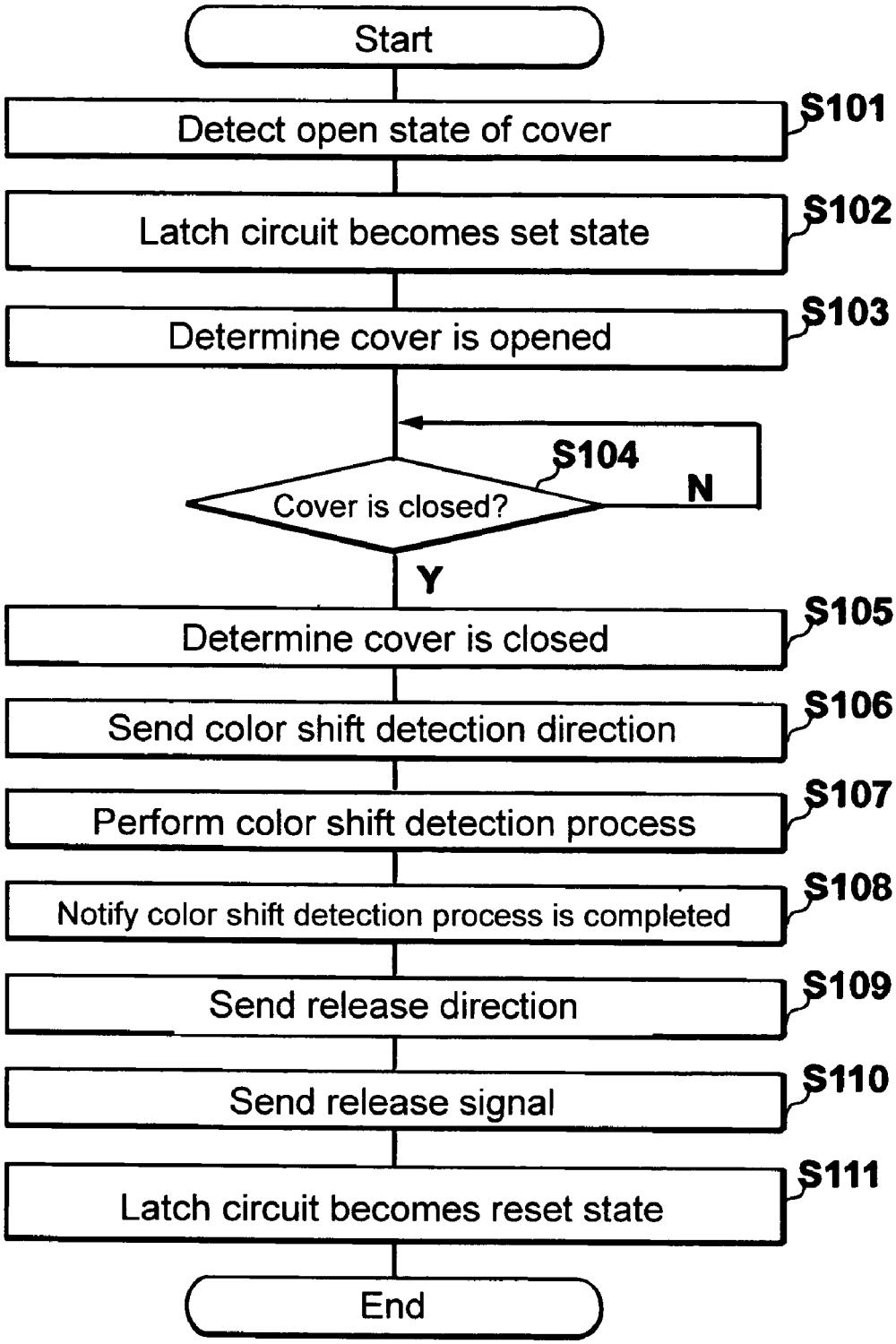
FIG. 8 is a flow chart showing an operation of the color printer for detecting an open state and a close state of a cover according to the first embodiment of the present invention.

An operation of the color printer 10 when the cover 38 is opened and closed will be explained next. FIG. 8 is a flow chart showing the operation of the color printer 10 for detecting the open state and the close state of the cover 38 according to the first embodiment of the present invention.

While the main power source 60 supplies power, that is, power is turned on, when the cover 38 is opened and closed, the operation is performed as shown in FIG. 8 as follows.

In step S101, when the cover 38 is opened, the opening-closing detection switch 40 detects the open state of the cover 38 and is opened, so that the sub power source 61 supplies the voltage of 3.3 V to the latch circuit 62 and the mechanism control unit 50.

In step S102, the high level output is input from the sub power source 61 to the set input terminal 64 of the latch circuit 62. According to the high level input, the latch circuit 62 becomes the set state for retaining the open history, and the high level signal is output from the output terminal 66 to the mechanism control unit 50.

In step S103, in the mechanism control unit 50, the set signal is input from the latch circuit 62 to the determination unit 67, and the determination unit 67 receives the input from the sub power source 61. According to the input, the determination unit 67 determines that the cover 38 is opened.

In step S104, it is determined whether the cover 38 is closed. When the cover 38 is closed, the opening-closing detection switch 40 is closed for detecting the close state of the cover 38, and the input from the sub power source 61 to the latch circuit 62 and the mechanism control unit 50 becomes the low level.

Accordingly, in step S105, the determination unit 67 determines that the cover 38 is closed, and notifies the close state of the cover 38 to the control unit 70. At this time, although the input from the set input terminal 64 of the latch circuit 62 becomes the low level, the latch circuit 62 maintains the set state, and the high level signal continues to output from the output terminal 66.

In step S106, when the control unit 70 is notified that the cover 38 is closed, the control unit 70 sends the color shift detection direction to the execution unit 68 for performing the color shift detection process. In step S107, the execution unit 68 performs the color shift detection process. Accordingly, the color printer 10 detects the amount of the color shift in each color toner image with respect to the black toner image in the main scanning direction, the sub scanning direction, and the oblique direction, so that the mechanism control unit 50 stores the amount of the color shift.

In step S108, when the color shift detection process is completed, the execution unit 68 notifies the control unit 70 that the color shift detection process is completed. In step S109, the control unit 70 sends the release direction to the release unit 69, so that the latch circuit 62 releases the open history. In step S110, when the release unit 69 receives the release direction, the release unit 69 sends the release signal to the latch circuit 62.

In step S111, when the release signal is input to the reset input terminal 65 of the latch circuit 62, the latch circuit 62 becomes the reset state for releasing the open history according to the input, and the low level signal is output from the output terminal 66.

As described above, while the main power source 60 supplies power, when the open state and the close state of the cover are detected, the color shift detection process is performed.

While the main power source 60 stops supplying power, that is, power is turned off, when the cover 38 is opened and closed, the operation is performed as follows.

When the cover 38 is opened, the opening-closing detection switch 40 is opened, so that the high level output is input from the sub power source 61 to the latch circuit 62 and the mechanism control unit 50. When the high level output is input from the sub power source 61 to the set input terminal 64 of the latch circuit 62, the latch circuit 62 becomes the set state, and the high level signal is output from the output terminal 66 to the mechanism control unit 50.

When the cover 38 is closed afterward, the opening-closing detection switch 40 is closed for detecting the close state of the cover 38, and the input from the sub power source 61 to the latch circuit 62 and the mechanism control unit 50 becomes the low level. At this time, the latch circuit 62 maintains the set state, and the high level signal continues to output from the output terminal 66. Accordingly, while the main power source 60 stops supplying power, when the open state and the close state of the cover 38 are detected, the latch circuit 62 becomes the set state for retaining the open history.

Figure 9:
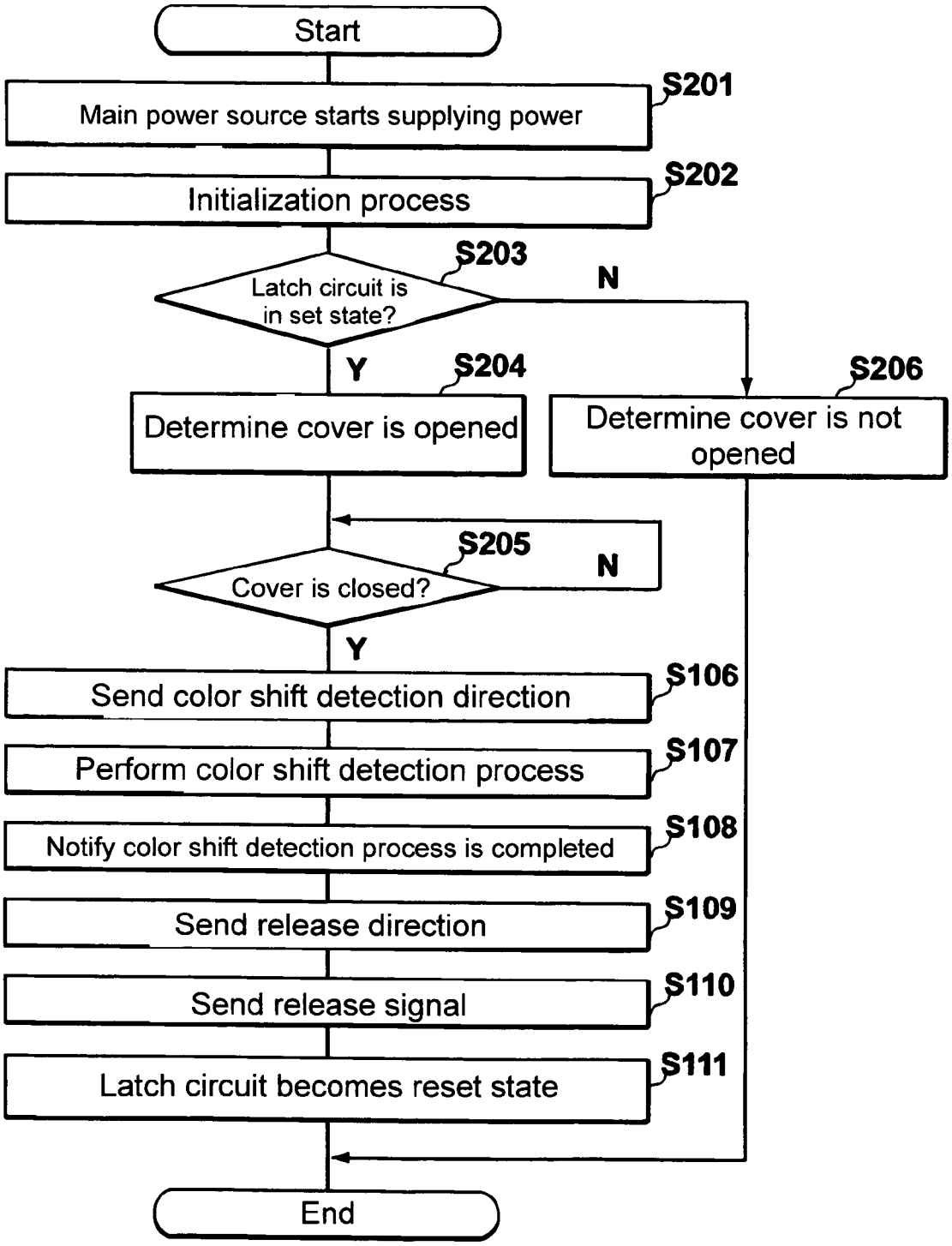
FIG. 9 is a flow chart showing a start-up operation of the color printer according to the first embodiment of the present invention.

An operation of the color printer 10 when the power switch 63 is closed and the main power source 60 starts supplying power will be explained next with reference to FIG. 9. FIG. 9 is a flow chart showing a start-up operation of the color printer 10 according to the first embodiment of the present invention.

While the main power source 60 stops supplying power, after the cover 38 is opened and closed, when the main power source 60 starts supplying power again, the operation is performed as shown in FIG. 9 as follows.

In step S201, in the color printer 10, the power switch 63 is closed and the main power source 60 starts supplying power. In step S202, the mechanism control unit 50 starts controlling each component, and performs an initialization process.

In step S203, the determination unit 67 determines whether the latch circuit 62 is in the set state or the reset state according to the input from the latch circuit 62. When the high level signal is input from the output terminal 66 of the latch circuit 62, the determination unit 67 determines that the latch circuit 62 is in the set state.

In step S204, the determination unit 67 determines that the cover 38 is opened while the latch circuit 62 retains the open history, that is, the main power source 60 stops supplying power.

In step S205, it is determined whether the cover 38 is closed. That is, the determination unit 67 determines the input level from the sub power source 61. When the input level from the sub power source 61 is the low level, the determination unit 67 determines that the opening-closing detection switch 40 is closed, that is, the cover 38 is closed. Accordingly, the determination unit 67 notifies the open history of the cover 38 to the control unit 70. When the cover 38 is opened, the determination unit 67 waits until the cover 38 is closed, and notifies the open history of the cover 38 to the control unit 70.

In step S106, when the control unit 70 is notified, the control unit 70 sends the color shift detection direction to the execution unit 68 for performing the color shift detection process. In step S107, the execution unit 68 performs the color shift detection process. Accordingly, the color printer 10 detects the amount of the color shift, so that the mechanism control unit 50 stores the amount of the color shift. In step S108, when the color shift detection process is completed, the execution unit 68 notifies the control unit 70 that the color shift detection process is completed.

In step S109, the control unit 70 sends the release direction to the release unit 69, so that the latch circuit 62 releases the open history. In step S110, when the release unit 69 receives the release direction, the release unit 69 sends the release signal to the latch circuit 62. In step S111, when the release signal is input to the reset input terminal 65 of the latch circuit 62, the latch circuit 62 becomes the reset state for releasing the open history according to the input, and the low level signal is output from the output terminal 66. Afterward, the color printer 10 becomes an idle state.

As described above, when the latch circuit 62 is in the set state, it is determined that the open state of the cover 38 is detected while the main power source 60 stops supplying power. The color shift detection process is performed in the initialization process after power is turned on.

While the main power source 60 stops supplying power, when the cover 38 is not opened or closed, the operation is performed as shown in FIG. 9 as follows.

In step S201, in the color printer 10, the power switch 63 is closed and the main power source 60 starts supplying power. In step S202, the mechanism control unit 50 performs the initialization process. In step S203, the determination unit 67 determines whether the latch circuit 62 is in the set state or the reset state according to the input from the latch circuit 62. When the low level signal is input from the output terminal 66 of the latch circuit 62, the determination unit 67 determines that the latch circuit 62 is in the reset state.

In step S206, the determination unit 67 determines that the cover 38 is opened while the latch circuit 62 does not retain the open history, that is, the open state of the cover 38 is not detected while the main power source 60 stops supplying power. Accordingly, the determination unit 67 notifies the detection result to the control unit 70.

When the control unit 70 receives the detection result, the control unit 70 determines that the color shift detection process is not necessary. Accordingly, the process bypasses from step S107 to step S112 shown in FIG. 9, and the color printer 10 becomes the idle state.

As described above, when the latch circuit 62 is in the reset state, it is determined that the open state of the cover 38 is not detected while the main power source 60 stops supplying power. Accordingly, the color shift detection process is eliminated in the initialization process after power is turned on.

As described above, in the embodiment, when the cover 38 is opened or closed while the power supply is stopped, the situation is detected, so that the latch circuit 62 becomes the set state for retaining the open state of the cover 38. Accordingly, when the power supply is resumed, according to the state of the latch circuit 62, it is possible to determine whether the open state exists.

Accordingly, when it is determined that the cover 38 is not opened or closed, it is possible to eliminate the process such as the color shift detection process to be performed upon opening or closing the cover 38. As a result, it is possible to reduce cost associated with the printing the pattern for detecting the color shift on the transport belt 22, the detection of the amount of the color shift, a drum cleaning process after the detection, and the likes. Further, it is possible to reduce the startup time.

In the embodiment, the patterns for detecting the color shift shown in FIGS. 5(A) and 5(B) to 7 are just an example, and are not limited thereto. It is possible to adjust the width and the interval of the lines in each block, the number of the blocks, and the likes according to a range of the color shift to be detected.

Second Embodiment

A second embodiment of the present invention will be described below. In the description below, elements in the second embodiment similar to those in the first embodiment are designated by same reference numerals, and explanations thereof are omitted. Explanations of operations and effects in the second embodiment similar to those in the first embodiment are omitted.

Figure 10:
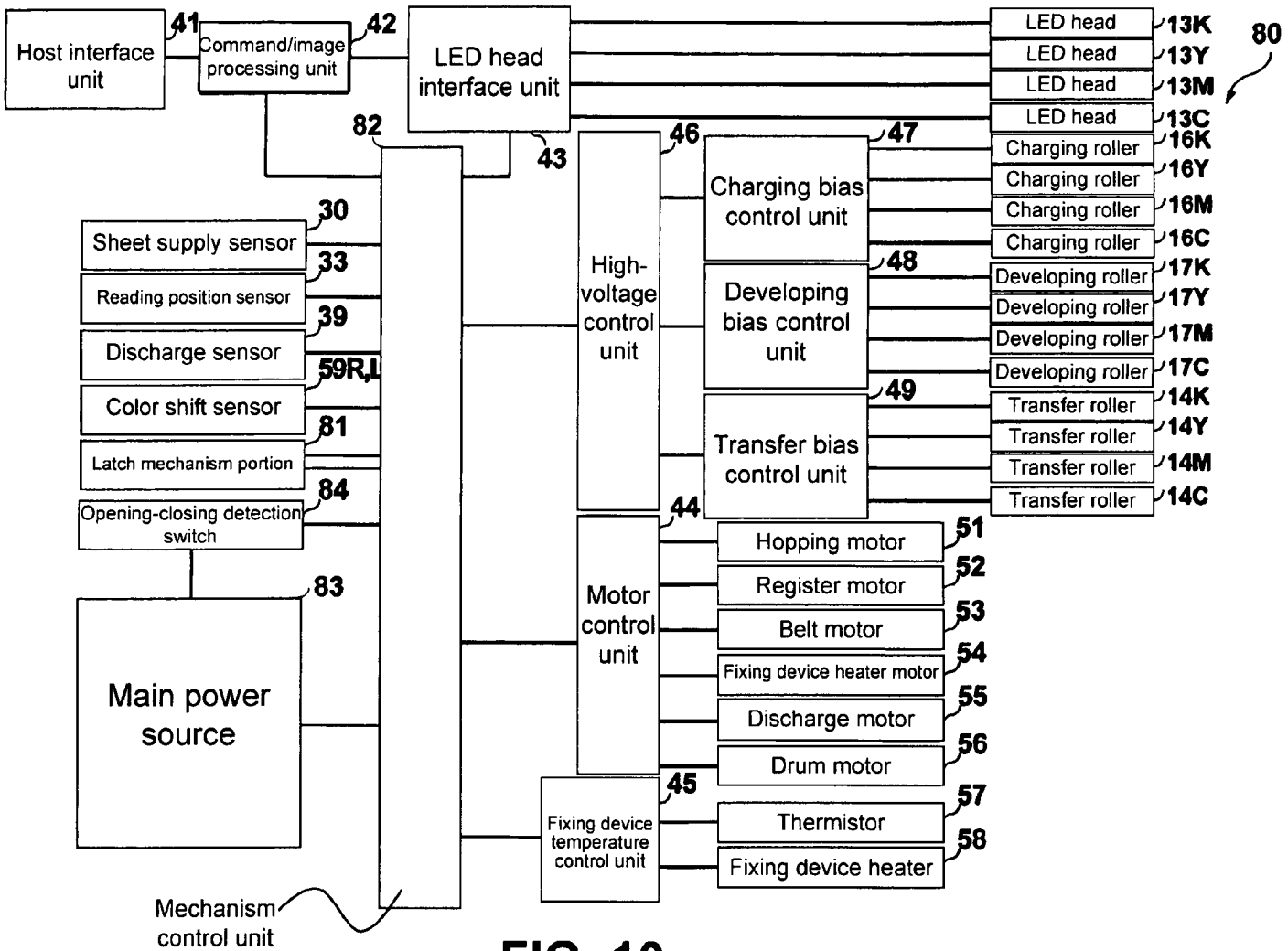
FIG. 10 is a block diagram showing a configuration of a color printer according to a second embodiment of the present invention.

FIG. 10 is a block diagram showing a configuration of a color printer 80 according to the second embodiment of the present invention. Different from the first embodiment, in the second embodiment, the color printer 80 is not provided with the sub power source 61 and the latch circuit 62, and is provided with a latch mechanism portion 81 instead.

As shown in FIG. 10, the color printer 80 includes the host interface unit 41; the command/image processing unit 42; the LED head interface unit 43; the motor control unit 44; the fixing device temperature control unit 45; the high-voltage control unit 46; the charging bias control unit 47; the developing bias control unit 48; the transfer bias control unit 49; and a mechanism control unit 82.

As shown in FIG. 10, the color printer 80 further includes a main power source 83, an opening-closing detection switch 84, and the latch mechanism portion 81.

In the embodiment, the main power source 83 generates a voltage of 24 V for driving the mechanisms, a voltage of 5 V for driving the sensors, and a voltage of 3.3 V for driving the CPU, thereby supplying power to each component through the mechanism control unit 82. The power switch 63 is connected to the main power source 83. When the power switch 63 is closed to become a power on state, the main power source 83 starts supplying power to the mechanism control unit 82. Further, the main power source 83 supplies power to the opening-closing detection switch 84.

Similar to the opening-closing detection switch 40 shown in FIG. 2, the opening-closing detection switch 84 is disposed at the cover 38, and receives power from the main power source 83 to operate upon opening or closing the cover 38 for detecting the open state and the close state of the cover 38, thereby notifying the mechanism control unit 82 of the detection result.

In the embodiment, the latch mechanism portion 81 functions as a retaining portion for retaining the open history indicating that the cover 38 is opened, and sends a signal to the mechanism control unit 82 depending on whether the retaining portion retains the open history.

Figure 11:
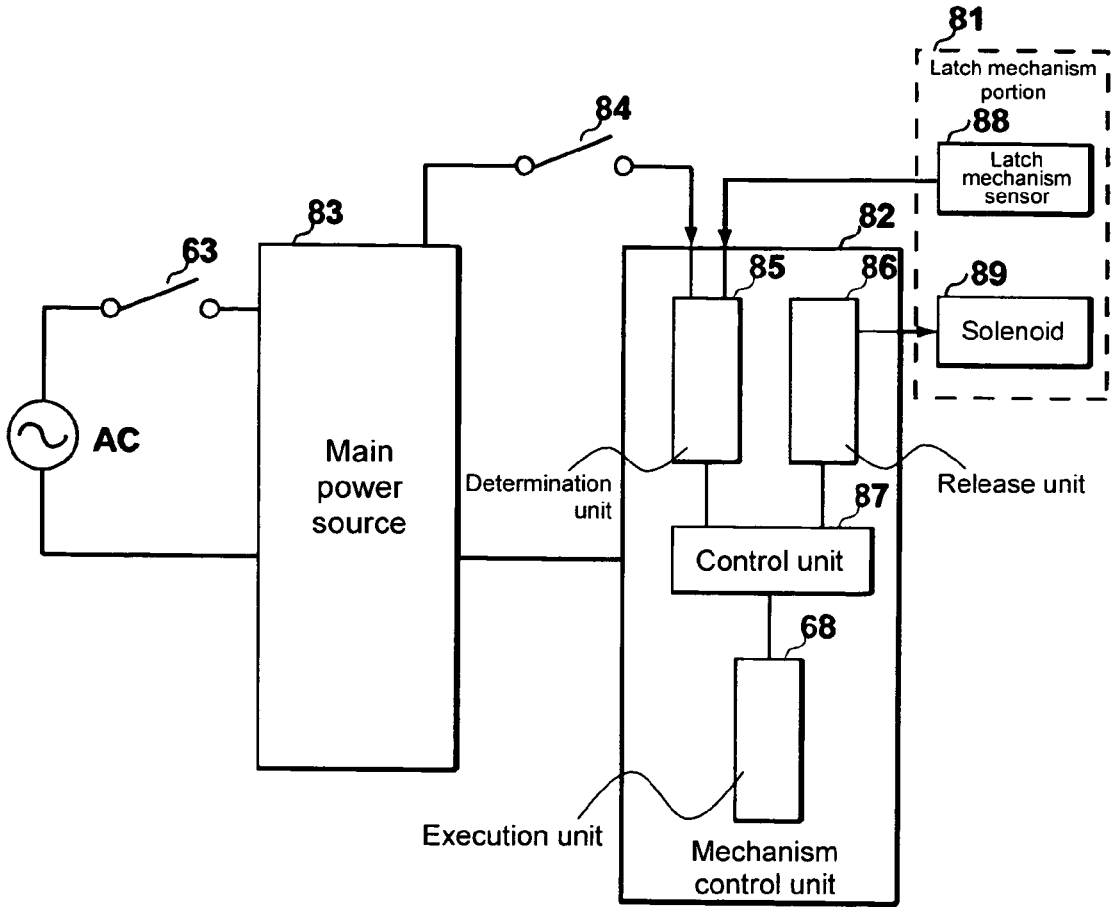
FIG. 11 is a block diagram showing a circuit diagram including a latch mechanism portion according to the second embodiment of the present invention.

A functional configuration of the latch mechanism portion 81 and the mechanism control unit 82 will be explained in more detail next with reference to FIG. 11. FIG. 11 is a block diagram showing a circuit diagram including the latch mechanism portion 81 according to the second embodiment of the present invention.

In the embodiment, the opening-closing detection switch 84 operates upon opening or closing the cover 38, so that the opening-closing detection switch 84 notifies the mechanism control unit 82 that the open state of the cover 38 is detected. For example, in the close state of the cover 38, an output from the main power source 83 is input to the mechanism control unit 82 through the opening-closing detection switch 84. When the cover 38 becomes the open state, and the opening-closing detection switch 84 is opened, the input to the mechanism control unit 82 through the opening-closing detection switch 84 is terminated.

As shown in FIG. 11, the mechanism control unit 82 includes a determination unit 85; the execution unit 68; a release unit 86; and a control unit 87 for controlling the determination unit 85, the execution unit 68, and the release unit 86.

In the embodiment, while the main power source 83 supplies power, when the cover 38 is opened, the input to the determination unit 85 from the main power source 83 through the opening-closing detection switch 84 is terminated. When the cover 38 is closed, the output from the main power source 83 is input to the determination unit 85 through the opening-closing detection switch 84. Then, the determination unit 85 notifies the control unit 87 for performing the color shift detection process.

After the main power source 83 stops supplying power, when the power switch 63 is closed to resume the power supply, that is, power is turned on again, the determination unit 85 determines whether the color shift detection process is necessary according to a signal input from the latch mechanism portion 81.

In the embodiment, according to a release direction from the control unit 87, the release unit 86 outputs a signal to the latch mechanism portion 81 for releasing the open history retained in the latch mechanism portion 81. When the determination unit 85 notifies the control unit 87 that the color shift detection process is necessary, the control unit 87 sends the color shift detection direction to the execution unit 68. After the color shift detection process is completed, the control unit 87 sends the release direction to the release unit 86.

As shown in FIG. 11, the latch mechanism portion 81 is provided with a latch mechanism sensor 88 and a solenoid 89. The latch mechanism sensor 88 is formed of, for example, a photo-interceptor.

In the embodiment, the latch mechanism sensor 88 functions as a detection unit for detecting the open history of the cover 38 while the main power source 83 stops supplying power, that is, power is turned off. More specifically, the latch mechanism sensor 88 detects a light interrupted state or a light radiation state, and sends a signal to the mechanism control unit 82 according to a detection result.

In the embodiment, the light interrupted state and the light radiation state detected with the latch mechanism sensor 88 correspond to a set state and a reset state of the latch mechanism portion 81 (described later), respectively. When the latch mechanism sensor 88 detects the light interrupted state, the latch mechanism sensor 88 sends a set signal. When the latch mechanism sensor 88 detects the light radiation state, the latch mechanism sensor 88 sends a reset signal.

In the embodiment, the solenoid 89 functions as a release member, so that the mechanism control unit 82 drives the solenoid 89 to release the open history retained in the latch mechanism portion 81.

A configuration of the latch mechanism portion 81, and an operation of the latch mechanism portion 81 when the cover 38 is opened and closed will be explained. FIGS. 12(A) to 12(D) are schematic views showing the operation of the latch mechanism portion 81 according to the second embodiment of the present invention.

As shown in FIGS. 12(A) to 12(D), in addition to the latch mechanism sensor 88 and the solenoid 89 shown in FIG. 11, the latch mechanism portion 81 is further provided with latch claws 90 and 92.

In the embodiment, the latch claw 90 functions as a blocking member. In the open state of the cover 38, when an end portion 38B of the cover 38 pushes the latch claw 90, the latch claw 90 moves downwardly. The latch claw 90 includes a spring 91. When the latch claw 90 moves downwardly, the spring 91 contracts for applying an elastic force upwardly to the latch claw 90.

In the embodiment, the latch claw 92 functions as a holding member. When the latch mechanism portion 81 is in the set state (described later), the latch claw 92 engages the latch claw 90 moved downwardly, thereby maintaining a downwardly moved position of the latch claw 90. An arm with a spring 93 is disposed between the latch claw 92 and the solenoid 89.

Figure 12:
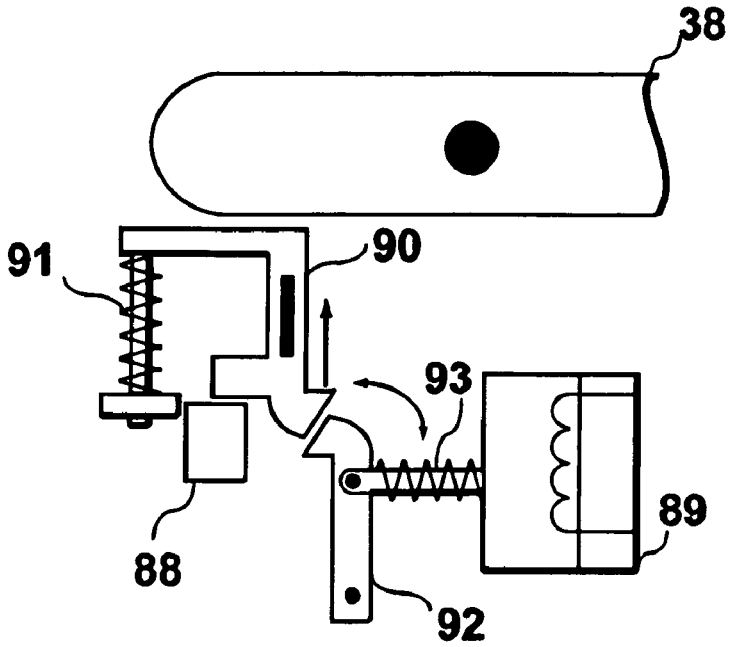
FIGS. 12(A) to 12(D) are schematic views showing an operation of the latch mechanism portion according to the second embodiment of the present invention.
Figure 12:
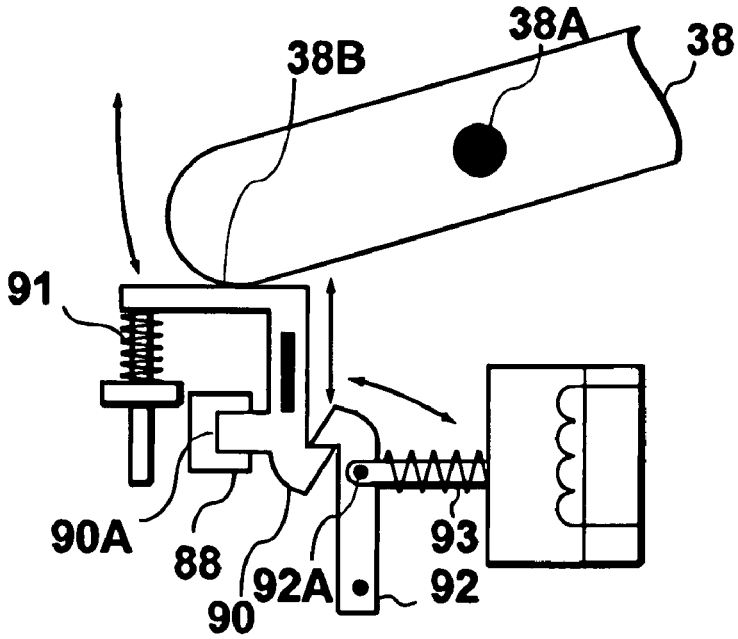
Figure 12:
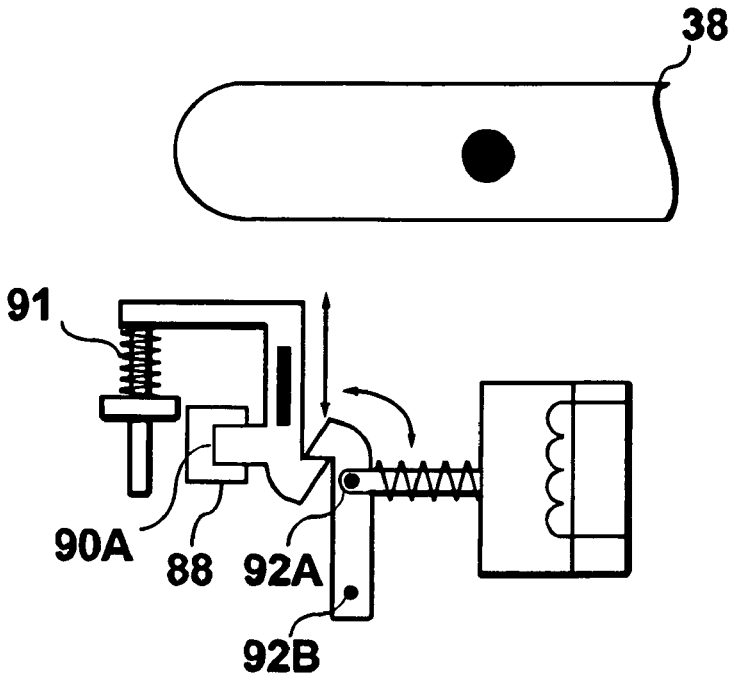
Figure 12:
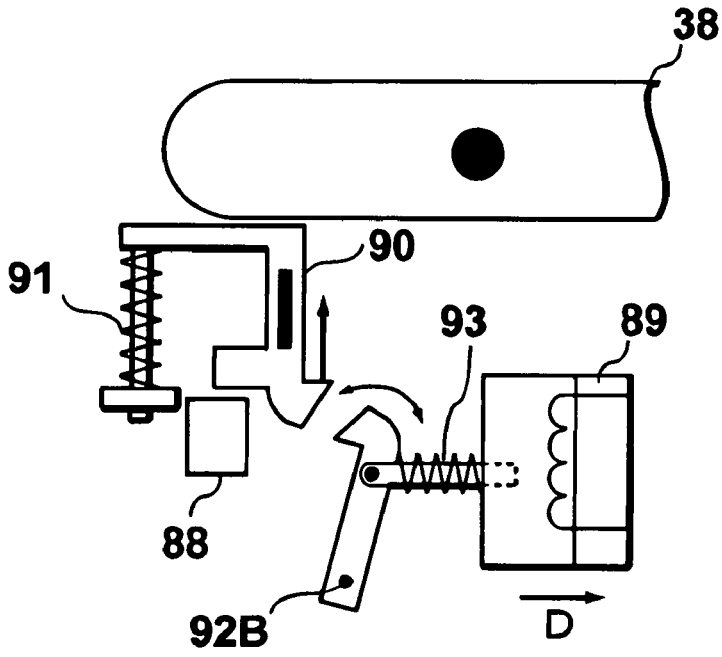

FIG. 12(A) is a view showing the reset state in which the latch mechanism portion 81 does not retain the open history. As shown in FIG. 12(A), the cover 38 is closed, and the latch claw 90 does not move. In this state, the latch mechanism sensor 88 is capable of detecting the light radiation state, so that the latch mechanism sensor 88 sends the reset signal to the mechanism control unit 82.

FIG. 12(B) is a view showing a state that the cover 38 is opened from the reset state shown in FIG. 12(A). The cover 38 rotates around a supporting shaft 38A, and the end portion 38B abuts against the latch claw 90 to push the latch claw 90 downwardly. When the end portion 38B pushes the latch claw 90, the latch claw 90 moves downwardly against the elastic force of the spring 91.

As shown in FIG. 12(B), the latch claw 90 abuts against the latch claw 92 to rotate the latch claw 92 around a shaft 92A, and moves downwardly further to engages the latch claw 92 at a further lower position. At this moment, an arm portion 90A of the latch claw 90 blocks light. Accordingly, the latch mechanism sensor 88 detects the light interrupted state and sends the set signal to the mechanism control unit 82. Then, the latch mechanism portion 81 retains the engagement state as the open history, and becomes the set state.

FIG. 12(C) is a view showing a state that the cover 38 is closed from the set state shown in FIG. 12(B). Although the end portion 38B of the cover 38 moves away from the latch claw 90, the latch claw 90 engages the latch claw 92, thereby holding the current position thereof. That is, the latch mechanism portion 81 maintains the set state, and the latch mechanism sensor 88 is capable of detecting the light interrupted state and sending the set signal.

FIG. 12(D) is a view showing the reset state released from the set state shown in FIG. 12(C). In this state, the mechanism control unit 82 drives the solenoid 89 to generate an electromagnetic force in an arrow direction D. Accordingly, the latch claw 92 is pulled backward with the electromagnetic force through the arm 93. As a result, the latch claw 92 rotates around a shaft 92B and moves backward while contracting the spring provided in the arm 93, thereby disengaging the latch claw 90.

Accordingly, the latch claw 90 is pushed upwardly with the elastic force of the spring 91. When the mechanism control unit 82 stops driving the solenoid 89, the latch claw 92 is pushed back to the original position with the elastic force of the spring provided in the arm 93. As a result, the latch mechanism portion 81 returns to the reset state shown in FIG. 12(A).

Figure 13:
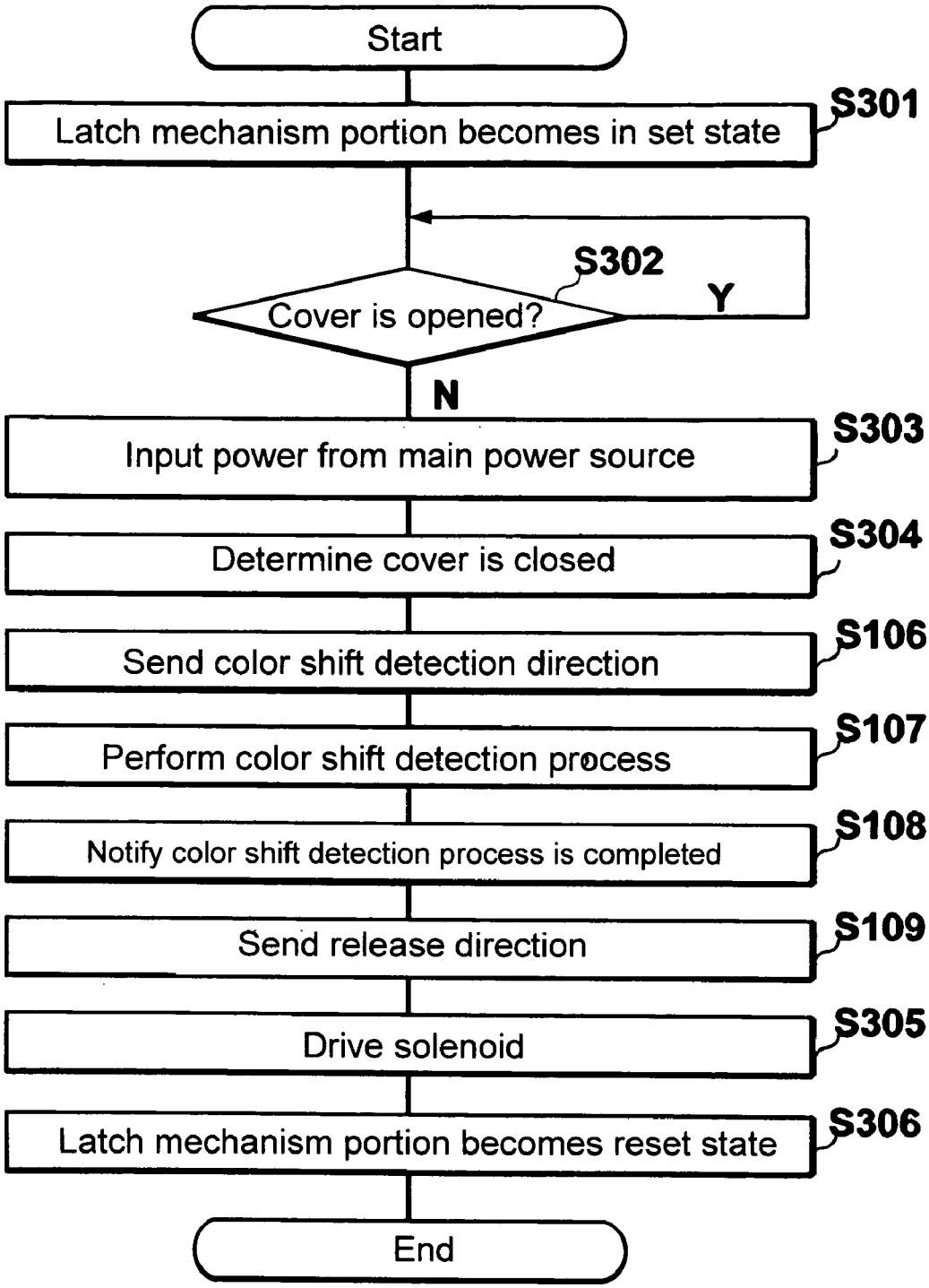
FIG. 13 is a flow chart showing an operation of the color printer for detecting an open state and a close state of a cover according to the second embodiment of the present invention.

An operation of the color printer 80 when the cover 38 is opened and closed will be explained next. FIG. 13 is a flow chart showing the operation of the color printer 80 for detecting an open state and a close state of the cover 38 according to the second embodiment of the present invention.

While the main power source 83 supplies power, that is, power is turned on, when the cover 38 is opened and closed, the operation is performed as shown in FIG. 13 as follows.

In step S301, when the cover 38 is opened, in the latch mechanism portion 81, the cover 38 pushes the latch claw 90 downwardly, so that the latch claw 90 moves to the lower position shown in FIG. 12(A). Then, the latch claw 90 engages the latch claw 92, and the latch mechanism portion 81 becomes the set state indicating that the open history is retained.

In this state, the latch mechanism sensor 88 detects the light interrupted state, and sends the set signal to the mechanism control unit 82. Further, the opening-closing detection switch 84 is opened upon detecting the open state of the cover 38, and the input from the main power source 83 to the mechanism control unit 82 through the opening-closing detection switch 84 is terminated. Upon the termination of the input, the determination unit 85 determines that the cover 38 is opened.

In step S302, it is determined whether the cover 38 is closed. In step S303, when it is determined that the cover 38 is closed, the opening-closing detection switch 84 is closed, and the output from the main power source 83 is input to the mechanism control unit 82 through the opening-closing detection switch 84. In step S304, the determination unit 85 determines that the cover 38 is closed, and notifies the control unit 87 of the close state of the cover 38. Note that, during this period of time, the latch mechanism portion 81 maintains the set state shown in FIG. 12(C), and the latch mechanism sensor 88 continues to send the set signal.

In step S106, when the control unit 87 is notified that the cover 38 is closed, the control unit 87 sends the color shift detection direction to the execution unit 68 for performing the color shift detection process. In step S107, the execution unit 68 performs the color shift detection process. The operation of the color printer 80 in the color shift detection process is similar to that in the first embodiment, and an explanation thereof is omitted.

Accordingly, the color printer 80 detects the amount of the color shift in each color toner image with respect to the black toner image in the main scanning direction, the sub scanning direction, and the oblique direction, so that the mechanism control unit 82 stores the amount of the color shift. In step S108, when the color shift detection process is completed, the execution unit 68 notifies the control unit 87 that the color shift detection process is completed.

In step S109, the control unit 87 sends the release direction to the release unit 86, so that the release unit 86 releases the open history retained in the latch mechanism portion 81. In step S305, when the release unit 86 receives the release direction, the release unit 86 drives the solenoid 89 for a specific period of time.

When the release unit 86 drives the solenoid 89, in the latch mechanism portion 81, the latch claw 92 moves backward, so that the latch claw 92 is disengaged from the latch claw 90 as shown in FIG. 12(D). Then, the latch claw 90 is pushed upwardly with the elastic force of the spring 91. Afterward, when the release unit 86 stops driving the solenoid 89, the latch claw 92 is pushed back to the original position with the elastic force of the spring of the arm 93. Accordingly, in step S306, the latch mechanism portion 81 becomes the reset state as shown in FIG. 12(A). In this state, the latch mechanism sensor 88 detects the light radiation state, and sends the reset signal to the mechanism control unit 82.

As described above, in the embodiment, when the open state and the close state of the cover 38 are detected while the main power source 83 supplies power, the color shift detection process is performed.

While the main power source 83 stops supplying power, that is, power is turned off, when the cover 38 is opened and closed, the operation is performed as follows.

While power is turned off, when the cover 38 is opened, the latch claw 90 engages the latch claw 92, so that the latch mechanism portion 81 becomes the set state as shown in FIG. 12(B). Afterward, when the cover 38 is closed, the latch mechanism portion 81 maintains the set state as shown in FIG. 12(C).

As described above, While the main power source 83 stops supplying power, that is, power is turned off, when the open state and the close state of the cover 38 are detected, the latch mechanism portion 81 becomes the set state, thereby retaining the open history.

Figure 14:
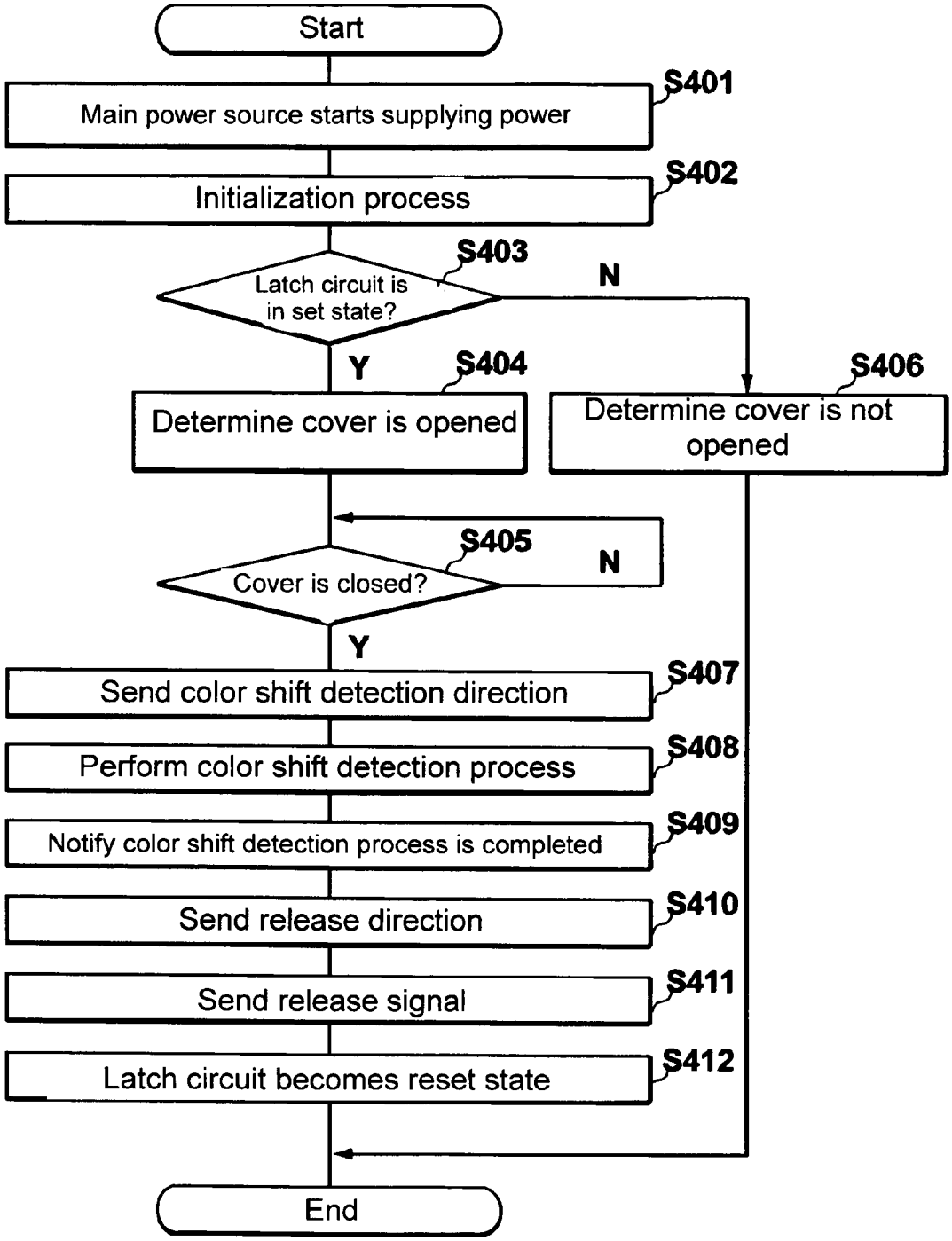
FIG. 14 is a flow chart showing a start-up operation of the color printer according to the second embodiment of the present invention.

An operation of the color printer 80 when the power switch 63 is closed and the main power source 83 starts supplying power will be explained next with reference to FIG. 14. FIG. 14 is a flow chart showing a start-up operation of the color printer 80 according to the second embodiment of the present invention.

While the main power source 83 stops supplying power, after the cover 38 is opened and closed, when the main power source 60 starts supplying power again, the operation is performed as shown in FIG. 14 as follows.

In step S401, in the color printer 80, the power switch 63 is closed, and the main power source 83 starts supplying power. In step S402, the mechanism control unit 82 starts controlling each component, and performs an initialization process.

In step S403, the determination unit 85 determines whether the latch mechanism portion 81 is in the set state or the reset state according to the input from the latch mechanism portion 81. When the latch mechanism sensor 88 detects the light interrupted state and sends the set signal (refer to FIG. 12(C)), the determination unit 85 determines that the latch mechanism portion 81 is in the set state.

In step S404, the determination unit 85 determines that the cover 38 is opened while the latch circuit 62 retains the open history, that is, the main power source 83 stops supplying power.

In step S405, it is determined whether the cover 38 is closed. That is, the determination unit 85 determines that there is the input through the opening-closing detection switch 84. When there is the input, the determination unit 85 determines that the opening-closing detection switch 40 is closed, that is, the cover 38 is closed. Accordingly, the determination unit 85 notifies the open history of the cover 38 to the control unit 87. When there is not the input, that is, the cover 38 is opened, the determination unit 85 waits for the input, and notifies the open history of the cover 38 to the control unit 87.

In step S407, when the control unit 70 is notified, the control unit 70 sends the color shift detection direction to the execution unit 68 for performing the color shift detection process. In step S408, the execution unit 68 performs the color shift detection process. Accordingly, the color printer 80 detects the amount of the color shift, so that the mechanism control unit 82 stores the amount of the color shift. In step S409, when the color shift detection process is completed, the execution unit 68 notifies the control unit 87 that the color shift detection process is completed.

In step S410, the control unit 87 sends the release direction to the release unit 86, so that the latch mechanism portion 81 releases the open history retained in the latch mechanism portion 81. In step S411, when the release unit 86 receives the release direction, the release unit 86 drives the solenoid 89 for a specific period of time. When the release unit 86 drives the solenoid 89, in the latch mechanism portion 81, the latch claw 90 is disengaged from the latch claw 92 as shown in FIG. 12(D), so that the latch claw 90 is pushed upwardly with the elastic force of the spring 91.

When the release unit 86 stops driving the solenoid 89, the latch claw 92 is pushed back to the original position with the elastic force of the spring of the arm 93. In step S412, the latch mechanism portion 81 becomes the reset state as shown in FIG. 12(A). Afterward, the color printer 80 becomes an idle state.

As described above, when the latch mechanism portion 81 is in the set state, it is determined that the open state of the cover 38 is detected while the main power source 83 stops supplying power. Accordingly, the color shift detection process is performed during the initialization process after power is turned on.

While the main power source 83 stops supplying power, when the cover 38 is not opened or closed, the operation is performed as shown in FIG. 14 as follows.

In step S401, in the color printer 80, the power switch 63 is closed and the main power source 83 starts supplying power. In step S402, the mechanism control unit 82 performs an initialization process. In step S403, the determination unit 85 determines whether the latch mechanism portion 81 is in the set state or the reset state according to the signal input from the latch mechanism portion 81. When the reset signal is sent from the latch mechanism sensor 88, the determination unit 85 determines that the latch mechanism portion 81 is in the reset state.

In step S406, the determination unit 85 determines that the latch mechanism portion 81 does not retain the open history, that is, the open state of the cover 38 is not detected while the main power source 83 stops supplying power. Accordingly, the determination unit 85 notifies the detection result to the control unit 87.

When the control unit 87 receives the detection result, the control unit 87 determines that the color shift detection process is not necessary. Accordingly, the process bypasses from step S407 to step S412 shown in FIG. 14, and the color printer 80 becomes the idle state.

As described above, when the latch mechanism portion 81 is in the reset state, it is determined that the open state of the cover 38 is not detected while the main power source 83 stops supplying power. Accordingly, the color shift detection process is eliminated in the initialization process after power is turned on.

As described above, in the embodiment, the color printer 80 is provided with the latch mechanism portion 81, and is capable of retaining the open history of the cover 38 without the sub power source 61 when power is turned off. Accordingly, it is not necessary to supply power all the time, thereby reducing cost.

In the first and second embodiments, the color shift detection process is the process to be executed upon opening and closing the cover, and the process is not limited thereto.

For example, when the cover is opened and the image forming unit is operated, toner may scatter in a surrounding area, thereby staining the photosensitive drum and lowering image quality. To this end, when the cover is opened and closed, a cleaning process is performed, in which the photosensitive drum rotates for a specific period of time, thereby removing stain on the surface of the photosensitive drum. It is possible to perform the cleaning process according to whether the open history is retained or not when power is turned on. In this case, in addition to the color printer, the present invention is applicable to a monochrome printer as the image forming apparatus.

The disclosure of Japanese Patent Application No. 2007-166218, filed on Jun. 25, 2007, is incorporated in the application.

While the invention has been explained with reference to the specific embodiments of the invention, the explanation is illustrative and the invention is limited only by the appended claims.

What is claimed is:

1. An image forming apparatus comprising:

an opening-closing lid for opening and closing an opening portion formed in an apparatus main body;

a detection unit for detecting an open state of the opening-closing lid;

an execution unit for executing a specific operation;

a main power source for supplying power to the execution unit;

a retaining unit for retaining an open history indicating that the open state of the opening-closing lid is detected when the detection unit detects the open state of the opening-closing lid during a period of time when the main power source does not supply power to the execution unit; and a determining unit for determining whether the execution unit executes the specific operation according to the open history retained in the retaining unit when the main power source starts supplying power to the execution unit.

2. The image forming apparatus according to claim 1, further comprising a control unit for controlling the execution unit to execute the specific operation when the determining unit determines that the execution unit executes the specific operation, and a release unit for releasing the open history retained in the retaining unit.

3. The image forming apparatus according to claim 1, further comprising a sub power source for supplying power to the determining unit, said determining unit electrically detecting the open state of the opening-closing lid and notifying a detection result to the execution unit, said retaining unit storing the open history according to the detection result, said determining unit determining whether the execution unit needs to execute the specific operation according to whether the retaining unit stores the open history.

4. The image forming apparatus according to claim 3, further comprising a control unit for controlling the execution unit to execute the specific operation when the determining unit determines that the retaining unit stores the open history, and a release unit for releasing the open history retained in the retaining unit.

5. The image forming apparatus according to claim 3, wherein said retaining unit includes a latch circuit, said detection unit including an opening-closing detection switch disposed between the sub power source and the latch circuit for operating so that the sub power source supplies power to the latch circuit when the open state is detected, said latch circuit storing the open history and sending a retaining signal indicating that the retaining unit retains the open history to the determining unit when the sub power source supplies power to the latch circuit, said determining unit determining whether the execution unit executes the specific operation according to the retaining signal.

6. The image forming apparatus according to claim 5, further comprising a control unit for controlling the execution unit to execute the specific operation when the determining unit determines that the execution unit executes the specific operation, and a release unit for sending a releasing signal to the latch circuit, said latch circuit deleting the open history and sending a reset signal indicating that the open history is deleted when the latch circuit receives the releasing signal.

7. The image forming apparatus according to claim 1, wherein said opening-closing lid is supported at the opening, portion to be rotatable, said detection unit including a blocking member moving upon receiving pressure from the opening-closing lid when the opening-closing lid rotates to open and an optical sensor for detecting a movement of the blocking member, said retaining unit including a holding member for holding the blocking member, said determining unit determining whether the execution unit executes the specific operation according to whether the optical sensor detects the movement of the blocking member.

8. The image forming apparatus according to claim 7, wherein said holding member includes a supporting member form supporting the blocking member and an urging member for urging the supporting member.

9. The image forming apparatus according to claim 7, further comprising a releasing member for releasing the blocking member from the holding member.

10. The image forming apparatus according to claim 1, Further comprising a plurality of image forming units for forming developer images on a recording medium using developer, in various colors, said execution unit including a color shift correction unit for correcting a shift in a position of the developer images.

11. The image forming apparatus according to claim 1, further comprising a control unit for controlling the execution unit to execute the specific operation when the determining unit determines that the execution unit executes the specific operation, and a release unit for resetting the open history retained in the retaining unit.

* * * * *